US006385426B1

(12) United States Patent
Kimura et al.

(10) Patent No.: US 6,385,426 B1
(45) Date of Patent: May 7, 2002

(54) IMAGE FORMING APPARATUS HAVING CONTACT AREA BETWEEN RECORDING MATERIAL BEARING MEMBER AND TRANSFER MEANS THAT IS LESS THAN CONTACT AREA BETWEEN IMAGE BEARING MEMBER AND RECORDING MATERIAL

(75) Inventors: Yoichi Kimura, Numazu; Masahiro Inoue, Mishima; Haruhiko Omata, Susono; Shinya Suzuki, Shizuoka-ken, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/617,538

(22) Filed: Jul. 14, 2000

(30) Foreign Application Priority Data

Jul. 16, 1999 (JP) ..... 11-203883
Jul. 11, 2000 (JP) ..... 12-209256

(51) Int. Cl.[7] ..... G03G 15/01
(52) U.S. Cl. ..... 399/302; 399/306; 399/309
(58) Field of Search ..... 399/297, 298, 399/299, 302, 306, 309; 430/126

(56) References Cited

U.S. PATENT DOCUMENTS 5,091,751 A 2/1992 Inoue et al. ..... 355/274
5,455,663 A 10/1995 Inoue et al. ..... 355/271
5,515,154 A 5/1996 Hasegawa et al. ..... 355/326 R
5,550,620 A 8/1996 Kimura et al. ..... 355/273
5,594,538 A 1/1997 Takekoshi et al. ..... 399/310
5,600,421 A 2/1997 Takekoshi et al. ..... 399/66
5,697,032 A 12/1997 Kimura et al. ..... 399/302
5,761,595 A * 6/1998 Tarnawskyj et al. ..... 399/308
5,930,572 A * 7/1999 Haneda et al. ..... 399/309

FOREIGN PATENT DOCUMENTS

JP 9-114269 * 5/1997

* cited by examiner

*Primary Examiner*—Arthur T. Grimley
*Assistant Examiner*—Hoan Tran
(74) *Attorney, Agent, or Firm*—Fitzpatrick, Cella, Harper & Scinto

(57) ABSTRACT

An image forming apparatus includes an image bearing member for bearing an image, a recording material bearing member for bearing a recording material electrostatically, and a transfer member for transferring the image on the image bearing member electrostatically to the recording material borne by the recording material bearing member by being put into contact with the recording material bearing member, wherein a length of a contact area between the recording material bearing member and the transfer member is less than that of a contact area between the image bearing member and the recording material borne by the recording material bearing member in a conveyance direction of the recording material bearing member, wherein the recording material bearing member has a first layer for bearing the recording material and a second layer in contact with the transfer member in an image transfer, and wherein a surface resistivity of the first layer is lower than a surface resistivity of the second layer.

49 Claims, 12 Drawing Sheets

IMAGE FORMING APPARATUS HAVING CONTACT AREA BETWEEN RECORDING MATERIAL BEARING MEMBER AND TRANSFER MEANS THAT IS LESS THAN CONTACT AREA BETWEEN IMAGE BEARING MEMBER AND RECORDING MATERIAL

BACKGROUND OF THE INVENTION

1. Field of the Invention

The present invention relates to an image forming apparatus using an electrophotographic process such as, for example, a copying machine, a printer, a facsimile or other image forming apparatus.

2. Related Background Art

Conventionally there are various color image forming apparatuses having a plurality of image forming sections, each of which forms a toner image having a color different from colors of other sections and transferring the toner images on an identical recording material with being sequentially superimposed to obtain a color image. Among these image forming apparatuses, a color copying machine with a polychromatic electrophotographic process is frequently used.

An example of this type of color electrophotographic copying machine is briefly described below by referring to FIG. 14. As shown in FIG. 14, the color electrophotographic copying machine includes a conveying belt 108 suspended between a pair of rollers 111 and caused to travel in a direction indicated by an arrow c by a driving source which is not shown and is provided with four image forming sections Pa, Pb, Pc, and Pd arranged above the conveying belt 108. The image forming sections have the same configuration and therefore the configuration will be outlined below by giving an example of the image forming section Pa of a first color.

The image forming section Pa has a drum-shaped image bearing member, that is, a photosensitive drum 101*a* rotating in a direction indicated by an arrow A and arranged in the vicinity of the conveying belt 108. After a photoconductive layer of a surface of the photosensitive drum 101*a* is uniformly charged by a primary charge 115*a*, a light image 116*a* of an yellow component of an original image is exposed to form an electrostatic latent image on the photosensitive drum 101*a*. The latent image shifts to a position of a developing device 103*a* by a rotation of the photosensitive drum 101*a* and developed by yellow toner supplied by the developing device 103*a* at the position, so that the latent image is visualized as a yellow toner image.

With a rotation of the photosensitive drum 101*a*, the yellow toner image reaches a transfer position where a blade-shaped transfer charger 104*a* having a conductive blade is disposed. At the same timing, a recording material, which is not shown, is supplied from the conveying path 112 onto the conveying belt 108 and then conveyed to a transfer position by the conveying belt 108. In addition a transfer bias is applied to the transfer charger 104*a*, by which the yellow toner image on the photosensitive drum 110*a* is transferred to the recording material.

Subsequently, a cleaning blade 130 of a cleaning unit cleans residual toner on the photosensitive drum 101*a*, by which the photosensitive drum 101*a* is prepared to enter the next image forming process. On the other hand, the recording material to which the yellow toner image is transferred advances to the next second-color image forming section Pb by conveyance with the conveying belt 108.

The second color image forming section Pb has the same configuration as the first color image forming section Pa, and therefore in the same manner as the above a latent image is formed on a photosensitive drum 101*b*, the latent image is developed by magenta toner, the obtained magenta toner image is transferred and superimposed on the yellow toner image on the recording material in its transfer portion. In the same manner, a cyan toner image and a black toner image are formed on the photosensitive drums 101*c* and 101*d* in the image forming sections Pc and Pd, respectively, and they are sequentially transferred and superimposed on the recording material by transfer chargers 104*c* and 104*d*, thereby achieving a color image having 4-color toner images superimposed on the recording material.

The recording material to which the 4-color toner images have been transferred is submitted to charge elimination and then separated from the conveying belt 8 by a separation charge-eliminator 161, conveyed to a fixing device 107 having a pair of a fixing roller 107*a* and a pressure roller 107*b*, and pressed and heated in a nip portion of the rollers 107*a* and 107*b* normally heated at a predetermined temperature for fixing. This mixes the colors of the toner images and fixes them to the recording material, by which a full-color permanent image is obtained and then the recording material is ejected to the outside of the copying machine.

After the recording material is separated from the conveying belt 106, an inside charge-eliminator 113 and an outside charge-eliminator 114 eliminate charges on the conveying belt received at the transfer and further a cleaning blade 120 and a backup roller 121 arranged in the downstream in a traveling direction remove rubbish or the like such as fog toner, scattered toner, or paper dust adhered to the surface of the conveying belt so as to clean the surface in preparation for the next image formation.

Additionally, in the image forming apparatus for forming a color image in the multi-transfer process, there has been used a single-layer resin belt made of polyethylene terephthalate resin, polycarbonate resin, or the like having a high resistance, specifically a volume resistivity of $10^{15}$ Ω·cm or greater for a purpose of attracting the recording material tightly for the transfer belt. For a transfer charging member, a transfer blade is recently used which enables a transfer electric field to be narrow in the transfer area in order to reduce a poor image such as a scatter at the transfer.

The transfer belt 108 used here is required to have various performances in order to convey the recording material stably and to achieve the multi-transfer of the 4-color toner image without any poor image.

It is a first reason for wide use of the transfer belt in the polychromatic image forming apparatus as described in this embodiment that the recording material is stably conveyed. In other words, in an image forming apparatus in which a recording material passes a plurality of image forming sections during the multi-transfer of respective colors, the image forming sections form images of their own colors in accordance with a timing when the recording material is conveyed and the images are sequentially transferred to the conveyed recording material. Unless the recording material is electrostatically attracted to the transfer belt nor fixed by any means during conveyance, the recording material is not stably conveyed between the plurality of image forming sections, leading to misregistered images of the respective colors at the transfer or to any recording material jammed in the worst case. In this embodiment, the recording material supplied from the registration roller is integrated with the transfer belt to pass the transfer nip in the first image forming section, by which the toner image in the first image forming section is transferred, and electric charges are supplied to the both sides of the recording material and those of the transfer belt, by which the recording material and the transfer belt are electrostatically attracted to each other. At this point, electric resistance conditions of the transfer belt relate to the electrostatic attraction. In general, the electrostatic attracting force is generated by an electric field given to substances having different permittivities. If a transfer belt having a low electric resistance is used, however, electric charges given to the transfer belt surface are easily eliminated, by which the attracting force may be reduced.

Therefore, to obtain a conveyance effect of a stable electrostatic attracting force, it is preferable to use a transfer belt having a volume resistivity of about $10^{10}$ Ω·cm or higher and there is an example of a use of an insulating substance. The use of the insulating substance or a material having a high resistivity for the transfer belt in this manner, however, easily causes a separation electric-discharge on separating the recording material P which has completed to be processed with the 4-color multi-transfer from the transfer belt, and therefore the separation charge-eliminating function need be actively used in the separation section.

Next, the resistance conditions of the transfer belt significantly relate to a transfer effect. If the resistance of the transfer belt is low, there may be problems such as electric interference, a small-sized recording material, or a scatter. If high-resistant material such as an insulating substrate is used, a high voltage is applied, by which abnormal discharge easily occurs in various places, leading to an increased possibility of image degradation.

The electric interference is additionally described by using FIG. 14, for example. In FIG. 14, toner images on the respective photosensitive members formed by the four image forming sections are sequentially transferred by the respective transfer chargers in this configuration. If a resistance of the transfer belt is low, an electric field applied by the transfer charger corresponding to the first image forming section leaks to the second image forming section, and further to respective rollers around which the transfer belt is stretched or a driving roller, which obstructs the electric field contributing to transferring the toner image in the first image forming section. The electric interference means this phenomenon. The phenomenon may occur when using a material such as paper that has been left under a high-humidity environment.

Next, the small-sized recording material problem occurs particularly when using a sheet of the recording meterial shorter in the widthwise direction than a sheet of the maximum size on which the image forming apparatus can form an image. It will be described below by using FIG. 15.

Referring to FIG. 15, there is shown a diagram of the transfer portion of the image forming apparatus shown in FIG. 14, viewed from the traveling direction of the recording material, with a recording material having a shorter width (about ½) than image forming effective lengths of the photosensitive drum, the transfer belt, and the transfer charger existing in the center portion in the widthwise direction. If the recording material having the shorter width than the effective charging length of the transfer charger enters the transfer portion in this manner, the electric load (electric resistance) against the transfer charging bias varies by an amount of the recording material between an area where the recording material exists in the transfer portion and an area where the recording material does not exist in the transfer portion, and charging ability (an applied current amount) also varies. Estimating the variation, a resistance R1 in the nip portion where the recording material exists and a resistance R2 in the nip portion where the recording material does not exists are obtained as follows:

$$R1=(Rd+Pb+Rc+Rp)/dx=(R+Rp)/dx$$

$$R2=(Rd+Rb+Rc)/\{d(L-x)\}=R/\{d(L-x)\}R=Rd+Rb+Rc$$

where Rd, Rp, Rb, and Rc are the resistivity per unit area for the photosensitive drum, the recording material, the transfer belt, and the transfer charger ($\Omega\cdot cm^2$), respectively, d is a nip width (cm), L is an effective charging length (cm) of the transfer charger, x is a recording material width (cm), and V (V) is a given voltage applied to the transfer charger.

Assuming that V (v) is a charger voltage, current il flowing in the recording material section is obtained as follows:

$$il=V/R1=Vdx/(R+Rp) \quad (1)$$

On the other hand, a relation between a synthetic resistance RO and a total current I(A) pan be expressed as follows:

$$V=ROI$$

$$RO=R1R2/(R1+R2)=(R+Rp)/d/Lx\ \{1+Rp/R(1-x/L)\}^{-1}$$

Substituting these for the equation (1), $$il=xI/Lx\ \{1+Rp/R(1-x/L\}^{-1} \quad (2)$$

$$O<x<L$$

Therefore, the current In per unit length In the widthwise direction applied to the recording material is obtained by:

$$In(x)=I/Lx\{1+Rp/R(1-x/L)\}^{-1} \quad (3)$$

$$O<x<L$$

The equation (3) is a monotone increasing function on x. Therefore, when using a recording material having a shorter width than the effective charging length L of the transfer charger, the effectively applied current value is decreased. Additionally it is apparent from this function that, if Rp/R is relatively great, in other words, if the recording material is narrow In its width and thick with the high resistivity in the thickness direction, this decrease is remarkable. In this manner, if the current applied to the recording material is decreased, a toner image may be poorly transferred without achieving a complete transfer to the recording material depending on the degree of the decrease. There is almost no problem of this phenomenon if the resistance except the paper resistance Rp, i.e., R (=Rd+Rb+Rc) is large enough relative to Rp. Note that, however, the transfer belt resistivity Rb need be sufficiently high as well as the photosensitive drum resistivity Rd and the charger resistivity Rc.

Furthermore, scattering is a phenomenon that toner on a transfer portion or a transferred toner image after transfer processing is scattered over a white area. The toner image after the transfer is electrostatically retained on the recording material by electric charges given by the transfer charger on the back side of the transfer belt via the recording material and the transfer belt. If the transfer belt resistivity is low, however, its retaining force is reduced to be unstable.

Also at the transfer, if a transfer belt having a low resistance is used, a transfer electric field becomes wide and therefore a contribution of the transfer electric field occurs in the upstream of the transfer nip, thereby the transfer electric field is applied before the toner image enters the transfer nip. If the transfer electric field is applied before the recording material is brought into contact with the toner image in this manner, the toner image travels in the air, which may result in scattering of the toner image.

On the other hand, if the transfer belt resistivity is high, a high voltage is applied to the transfer charger itself, which may easily cause an abnormal discharge. In particular, the abnormal electric discharge occurred in the vicinity of the transfer nip may affect the transfer of the toner image to cause a poor image.

SUMMARY OF THE INVENTION

It is an object of the present invention to provide an image forming apparatus that keeps an ability of conveying a recording material to prevent poor images from occurring.

Other objects besides the above shall be apparent to those skilled in the art from the detailed description below.

DETAILED DESCRIPTION OF THE PREFERRED EMBODIMENTS

First Embodiment

Figure 1:
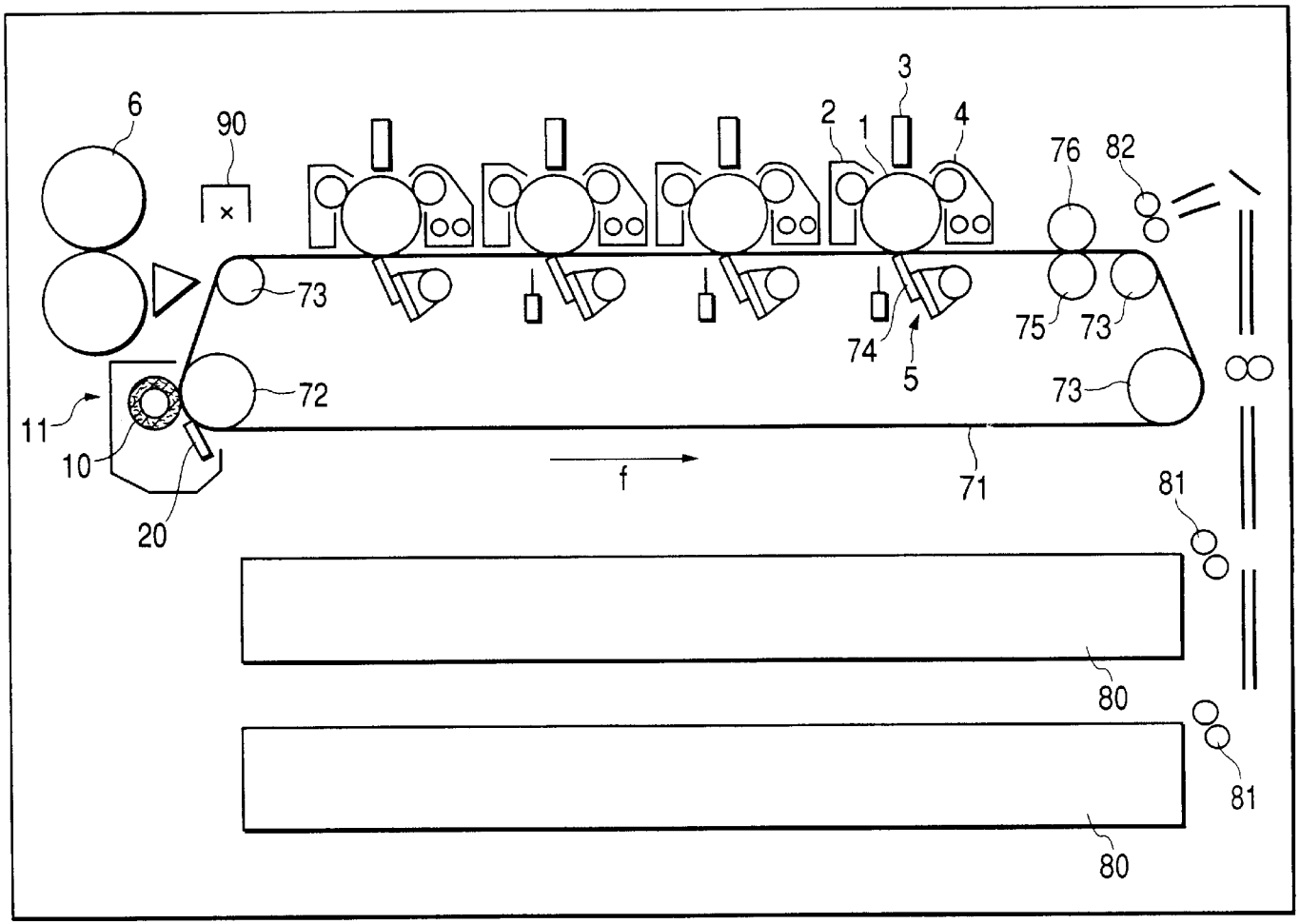
FIG. 1 is a schematic diagram showing an image forming apparatus according to the present invention.
Figure 2:
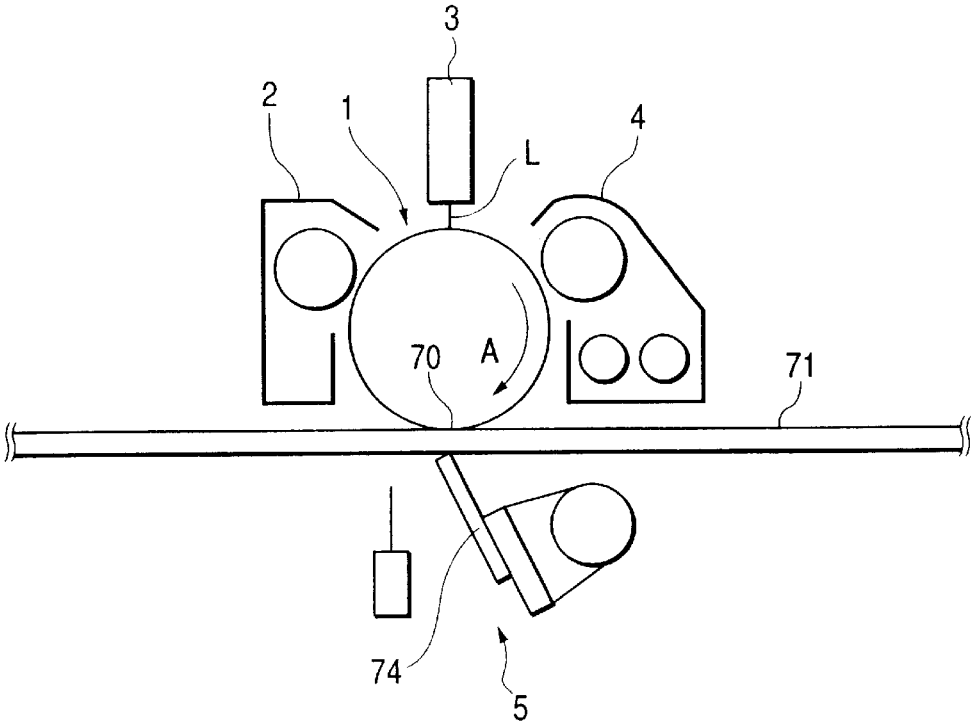
FIG. 2 is a schematic diagram showing an image forming section of the image forming apparatus according to the present invention.

A color image forming apparatus is described below by using schematic diagrams thereof shown in FIGS. 1 and 2. Referring to FIG. 1, there is shown a general configuration diagram of the image forming apparatus. Referring to FIG. 2, there is shown a detail view of an image forming section particularly related to an Image formation in FIG. 1.

In FIG. 2, reference numeral 1 designates a rotary drum-shaped photosensitive member as an image bearing member. This photosensitive member 1 is driven to rotate in a direction indicated by an arrow A at a predetermined peripheral speed (process speed) around a central shaft and submitted to a uniform charging process of a negative polarity in this embodiment by a magnetic brush 2 which is contact charging means in the rotation process.

Subsequently, the uniformly-charged surface of the photosensitive member 1 is exposed to an exposure light L modulated correspondingly to an image signal from an exposing device (LED exposing device) 3, by which electrostatic latent images corresponding to image information are sequentially formed on the photosensitive drum 1. The electrostatic latent images on the photosensitive member 1 are sequentially reversal-developed as toner images by a developing device 4 in this embodiment.

On the other hand, in FIG. 1 a recording material such as paper contained in a recording material feeding cassette 80 is fed by a feeding roller 81 one by one and supplied to the photosensitive member 1 and to a transfer device 5 which is transfer means at predetermined timings by a registration roller 82, so that a toner image on the photosensitive member 1 is transferred to the recording material.

Finally, the recording material to which the toner image has been transferred passes through a fixing device 6, by which the toner is fused and fixed by heat and pressure and then it is ejected to the outside of the apparatus as a fixed image.

For the photosensitive member 1, it is possible to use an organic photoconductor or the like used in general. It is preferable, however, to use a photosensitive member having a surface layer of a material having $10^9$ to $10^{14}$ Ω·cm resistivity on an organic photoconductor or an amorphous silicon photosensitive member, thereby achieving charge-injection charging which is effective to prevent ozone occurrence and to reduce power consumption. In addition, it is possible to improve charging effects.

Figure 3:
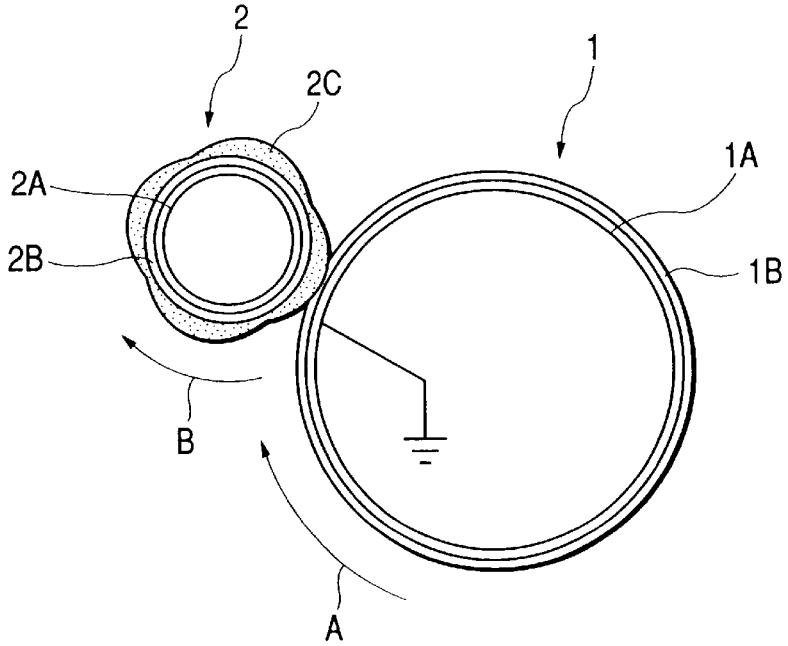
FIG. 3 is a schematic diagram showing a magnetic brush and a photosensitive member according to the present invention.

The photosensitive member 1 is, as shown in FIG. 3, a negatively-charged organic photoconductor in this embodiment, having a photoconductive layer 1B made of five layers, the first to fifth layers in an order from the innermost layer, on an aluminum-drum substrate 1A which is 30 mm in diameter, and is driven to rotate at a predetermined process speed (for example, 120 mm/sec). The innermost first layer of the photoconductive layer 1B is an undercoat layer, which is a conductive layer having a thickness of 20 μm arranged to correct a defect on the drum substrate 1A The second layer is a positive charge blocking layer, which prevents the positive charges injected from the drum substrate 1A from canceling the negative charges on the surface of the photosensitive member 1, and is a medium-resistance layer having a thickness of 1 μm whose resistivity is adjusted to around $10^6$ Ω·cm by using amilan resin and methoxymethyl nylon. The third layer is a charge generation layer, having a thickness of approx. 0.3 μm in which diazo group pigment is dispersed in a resin, and it generates pairs of positive and negative electric charges when being exposed. The fourth layer is a charge transport layer, in which hydrazone is distributed in a polycarbonate resin, and is a p type semiconductor.

Therefore, the negative charges on the surface of the photosensitive member 1 cannot travel in this layer and only the positive charges generated on the third layer (the charge generation layer) can be transported to the surface of the photosensitive member 1. The fifth layer of the outermost surface is a charge injection layer, which is a coating layer of a material in which ultrafine particles of $SnO_2$ are dispersed as conductive fine particles in a binder made of insulating resin. Specifically, it is a coating layer made of material obtained by dispersing ultrafine particles of $SnO_2$, having a particle diameter of approx. 0.03 $\mu$m generated by doping the insulating resin with antimony which is a light transmissive conductive filler to lower the resistivity (so as to be conductive), in the resin by 70 wt % relative to the resin. The charge injection layer is generated by spreading the coating fluid compounded in this manner at approx. 3 $\mu$m in a dip coating method, a spray coating method, a roll coating method, a beam coating method, or other appropriate coating methods.

The contact charging means is a magnetic brush charging device (hereinafter, a magnetic brush) 2 as shown in FIG. 3. The magnetic brush 2 is of a sleeve rotary type, comprising a stationary magnet roller 2A having a diameter of 16 mm, a nonmagnetic SUS sleeve 2B surrounding the magnet roller 2A rotatably, and a magnetic brush layer 2C of magnetic particles (magnetic carriers) attracted to the outer circumferential surface of the sleeve 2B and held by a magnetic force of the magnet roller 2A.

As magnetic particles forming the magnetic brush layer 2C, it is preferable to use particles having an average particle diameter 10 to 100 $\mu$m, saturated magnetization of 20 to 250 $Am^2/kg$, and a resistance of $1\times10^2$ to $1\times10^{10}$ $\Omega\cdot$cm. Taking into consideration a presence of an insulating defect like a pin hole on the photosensitive member 1, it is preferable to use particles having a resistance of $1\times10^6$ $\Omega\cdot$cm or higher. The resistance value of the magnetic particles has been measured by putting magnetic particles by 2 g into a metal cell having a bottom area of 228 $cm^2$, weighting them at 6.6 $kg/cm^2$, and then applying a voltage of 100 V.

To have a better charging performance, it is preferable to use particles having the resistance as low as possible. Therefore, the particles in this embodiment have an average particle diameter of 25 $\mu$m saturated magnetization of 200 $Am^2/kg$, and a resistivity of $5\times10^6$ $\Omega\cdot$cm and these particles of 40 g are magnetically attracted to the outer circumferential surface of the sleeve 2B to form the magnetic brush 2C. The magnetic particle comprises a resin carrier formed by dispersing a magnet as magnetic material in the resin and dispersing carbon black to achieve a conductive property or a resistance adjustment or substances produced by coating a surface of a magnetite simple substance such as ferrite with resin to adjust the resistance.

The magnetic brush layer 2C of the magnetic brush 2 is arranged so as to be put into contact with the surface of the photosensitive member 1. A 6 mm width of the contact nip portion (charging nip portion) n is provided between the magnetic brush layer 2C and the photosensitive member 1. Then, a predetermined charging bias voltage is applied from the power supply to the sleeve 2B, the surface of the photosensitive member 1 is rubbed by the magnetic brush layer 2C to which the charging bias is applied by rotatably driving the sleeve 28 in the contact nip portion n against the photosensitive member 1 at a peripheral speed of 150 mm/sec relative to the rotary speed of 120 mm/sec of the photosensitive member 1 in the direction indicated by an arrow B which is the counter direction to the rotary direction A of the photosensitive member 1, and a surface of the photosensitive layer 1B of the photosensitive member 1 is uniformly and primarily charged at a desired potential in the injection charging method. At this point, the higher rotary speed of the sleeve 2B increases contact opportunities between untransferred toner on the photosensitive member 1 and the magnetic brush 2, by which the collection effect of the magnetic brush 2 is improved.

Figure 4:
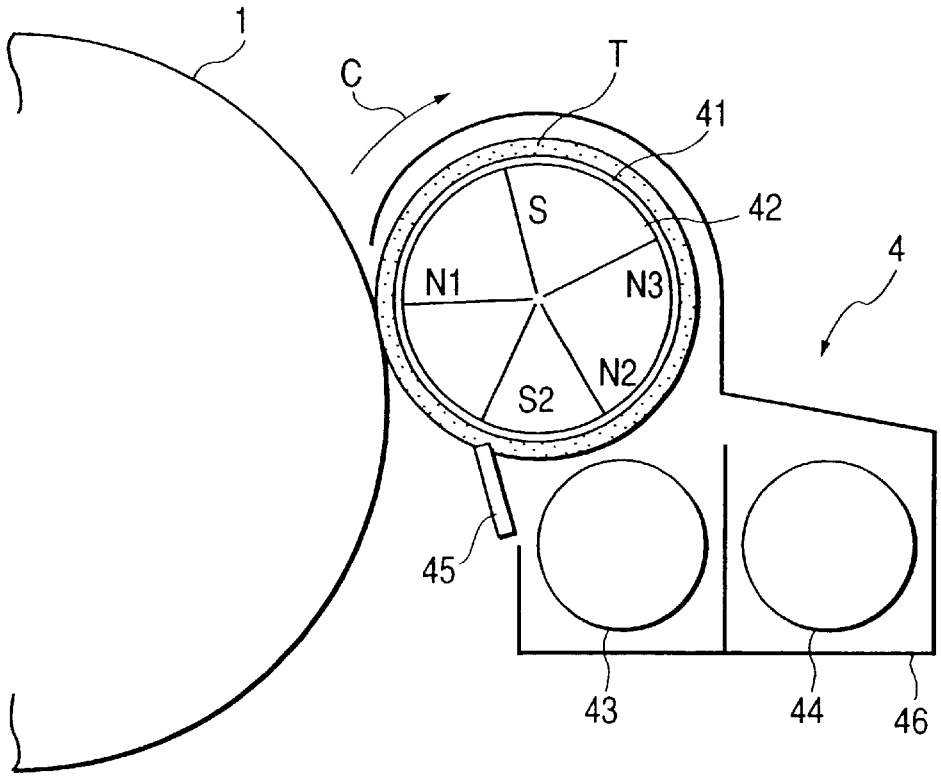
FIG. 4 is a schematic diagram showing a developing device according to the present invention.

Referring to FIG. 4, there is shown a schematic configuration diagram of a developing device 4 which is a two-component contact developing device in this embodiment. In this diagram, there are shown a sleeve 41 rotatably driven in a direction indicated by an arrow C, a magnet roller 42 stationarily arranged in the developing sleeve, agitating screws 43 and 44, a regulating blade 45 arranged to form a thin layer of developer T on the surface of the developing sleeve 41, and a developer container 46.

The developing sleeve 41 is arranged so as to be spaced approx. 450 $\mu$m apart from the photosensitive member 1 at the shortest distance from each other at least during development, so that the development can be performed in a condition that a thin layer Ta of the developer T formed on the developing sleeve 41 is brought into contact with the photosensitive member 1. Toner t as the developer T used in this embodiment is produced by externally adding titanium oxide having an average particle diameter 20 nm by weight ratio 1 wt % to negative charged toner having an average particle diameter 8 $\mu$m manufactured in the grinding method, and carrier c used here is magnetic carrier having an average particle diameter 35 $\mu$m and saturated magnetization of 205 $Am^2/kg$. In addition, the toner t mixed with the carrier c by weight ratio 6:94 is used as the developer T.

Next, a description will be given below for a developing process in which an electrostatic latent image on the surface of the photosensitive member 1 is visualized in the two-component magnetic brush method by using the developing device 4 and a circulating system of the developer T. First, the developer T scooped up at an N2 pole by a rotation of the developing sleeve 41 is regulated by the regulating blade 45 arranged perpendicularly to the developing sleeve 41 in a process of conveying the developer on the S2 pole and then the thin layer Ta of the developer T is formed on the developing sleeve 41. When the thin layer Ta of the developer T is conveyed to an N1 pole, a magnetic brush of developer is formed by a magnetic force. The electrostatic latent image is developed by this developer T which stands like the ears of rice, and subsequently the developer T on the developing sleeve 41 is returned to the developer container 46 by a repulsion magnetic field between the N3 and N2 poles.

A DC voltage and an AC voltage are applied from the power supply S2 to the developing sleeve 41. In this embodiment, the DC voltage of −500 V and the AC voltage of 1,500 V at a frequency 2,000 Hz are applied.

Generally in the two-component developing method, a development efficiency is increased when the AC voltage is applied and a high-grade image is obtained, while there is a disadvantage that it easily causes a fog contrarily. Therefore, the fog is prevented by providing an electric potential difference between the DC voltage applied to the developing device 4 and the surface potential of the photosensitive member 1 in general.

As shown in FIG. 1, the transfer device in this embodiment Is a belt transfer device and a transfer belt 71 having no ends as a recording material bearing member is stretched around a driving roller 72 and a driven roller 13 and it is driven to rotate at almost the same peripheral speed as a rotational peripheral speed of the photosensitive member 1 in a direction indicated by an arrow f. The ascending side belt portion of the transfer belt 71 is brought into contact with the lower surface of the photosensitive member 1 shown in FIG. 2. The recording material is conveyed to the transfer nip surface 70 with being borne on the upper surface of the ascending side belt portion of the transfer belt 71. A predetermined transfer bias is supplied from a transfer bias applying power supply to the transfer charging blade 74 as transfer means, by which the back side of the recording material is charged by a polarity opposite to the toner t to transfer the toner image on the surface of the photosensitive member 1 to the upper surface of the recording material.

Now, the following will precisely explain a constitution of the transfer belt 71 which is a characteristic of the present invention.

Figure 5:
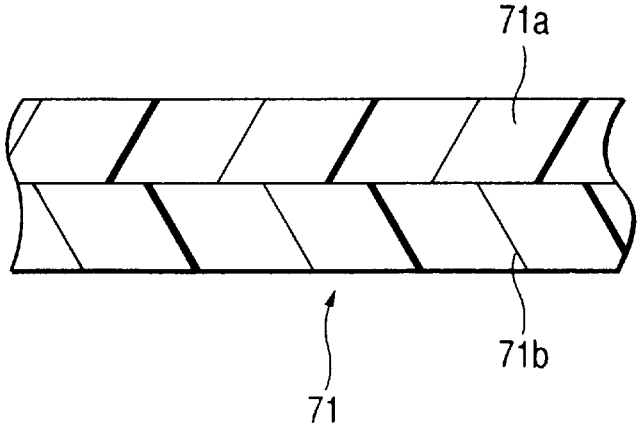
FIG. 5 is a schematic diagram showing a recording material bearing member according to the present invention.

FIG. 5 illustrates a sectional view of the transfer belt 71 used in the present embodiment. As illustrated in the sectional view, the transfer belt 71 is composed of two layers consisting of a surface layer 71*a* on which a recording member is borne and a back layer 71*b* to which each transfer charge blade is attached when a toner image is transferred. The surface layer 71*a* is formed with a thermosetting polyimide resin whose surface resistivity is adjusted to the range from $10^{11}$ Ω/□ or more to less than $10^{15}$ Ω/□ by dispersing carbon as a resistivity adjusting agent. The base resin of the back layer 71*b* is the same thermosetting polyimide resin as in the case of the surface layer 71*a*, but the resistivity adjusting agent has not been used and the one having a surface resistivity of $10^{15}$ Ω/□ or more and a volume resistivity of $10^{15}$ Ω·cm or more has been used. Namely, the surface resistivity of the surface layer is made smaller than the surface resistivity of the back layer. Also, a combined volume resistivity of the two layers is also $10^{15}$ Ω·cm or more. The surface resistivity and the volume resistivity are measured according to JIS K-6911, the value after one minute at applied voltage of 1 kv being used. AS the material of the transfer belt 71, an aromatic polyamide or an aromatic polyimide prepared by a similar method may be used. In addition, as the electrically conducting agent to be used, though carbon has been used in the present embodiment, any one which can impart electric conductivity, for example, metal powder, particles of metal oxide, or fillers may be used, without limiting to carbon.

The above-mentioned polyimide resin can be obtained by reacting almost equal molar amount of a tetracarboxylic dianhydride with a diamine in an organic solvent to prepare a polyamidic acid, followed by heating it to make it imide.

The tetracarboxylic dianhydride may be the compound represented by the following formula.

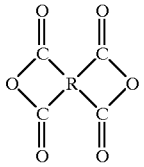

wherein, R is a tetravalent organic group, which may be an aromatic series, a fatty series, an alicyclic series, a combination of an aromatic series and a fatty series, or a substituted group thereof.

Examples thereof include pyromellitic dianhydride, 3,3',4,4'-benzophenonetetracarboxylic dianhydride, 3,3',4,4'-biphenyltetracarboxylic dianhydride, 2,3,3',4-biphenyltetracarboxylic dianhydride, 2,3,6,7-naphthalenetetracarboxylic dianhydride, 1,2,5,6-naphthalenetetracarboxylic dianhydride, 1,4,5,8-naphthalenetetracarboxylic dianhydride, 2,2'-bis(3,4-dicarboxyphenyl)propane dianhydride, bis(3,4-dicarboxyphenyl)sulfone dianhydride, perylene-3,4,9,10-tetracarboxylic dianhydride, bis(3,4-dicarboxyphenyl)ether dianhydride, ethylenetetracarboxylic dianhydride.

Examples of said diamine include 4,4'-diaminodiphenyl ether, 4,4'-diaminodiphenylmethane, 3,3'-diaminodiphenylmethane, 3,3'-dichlorobenzidine, 4,4'-aminodiphenyl sulfide-3,3'-diaminodiphenyl sulfone, 1,5-diaminonaphthalene, m-phenylenediamine, p-phenylenediamine, 3,3'-dimethyl-4,4'-biphenyldiamine, benzidine, 3,3'-dimethylbenzidine, 3,3'-dimethoxybenzidine, 4,4'-diaminophenyl sulfone, 4,4'-diaminodiphenyl sulfide, 4,4'-diaminodiphenylpropane, 2,4-bis(β-amino-tert-butyl)toluene, bis(p-β-amino-tert-butylphenyl)ether, bis(p-β-methyl-δ-aminophenyl)benzene, bis-p-(1,1-dimethyl-5-amino-pentyl)benzene, 1-isopropyl-2,4-m-phenylenediamine, m-xylylenediamine, p-xylylenediamine, di(p-aminocyclohexyl)methane, hexamethylenediamine, heptamethylenediamine, octamethylenediamine, nonamethylenediamine, decamethylenediamine, diaminopropyltetramethylene, 3-methylheptamethylenediamine, 4,4-dimethylheptametheylenediamene, 2,11-diaminododecane, 1,2-bis-3-aminopropoxyethane, 2,2-dimethylpropylenediamine, 3-methoxyhexamethylenediamlne, 2,5-dirmethylhexamethylenediamine, 2,5-dimethylheptamethylenediamine, 3-methylheptamethylenediamine, 5-methylnonamethylenediamine, 2,11-diaminododecane, 2,17-diaminoeicosadecane, 1,4-diaminocyclohexane, 1,10-diamino-1,10-dimethyldecane, 1,12-diaminooctadecane, 2,2-bis[4-(4-aminophenoxy)phenyl]propane, piperazine, $H_2N(CH_2)_3O(CH_2)_2O(CH_2)NH_2$, $H_2N(CH_2)_3S(CH_2)_3NH_2$, $H_2N(CH_2)_3N(CH_3)(CH_2)_3NH_2$.

Furthermore, the above-mentioned organic polar solvent used in synthesis of the polyamidic acid is the one possessing dipole(s) and functional group(s) which is not reactive to the tetracarboxylic dianhydride or the diamine. Also, the solvent must be inactive to the system and be act as a solvent for not only the product, i.e., polyamidic acid but also at least one of the reaction components, preferably both of them. Particularly, as the organic polar solvent, an N,N-dialkylamidic acid is useful, and its low molecular weight one such as N,N-dimetylacetamide or N,N-dimethylacetamidic acid may be exemplified. These compounds can be easily removed from polyamidic acids and shaped products of polyamidic acids by evaporation, replacement, or diffusion.

In addition, examples of the organic polar solvent other than the above include N,N-diethylformamide, N,N-diethylacetamide, N,N-dimethylmethoxyacetamide, dimethyl sulfoxide, hexamethylphsphric trianmide, N-methyl-2-pyrrolidone, pyridine, dimethyl sulfone, tetramethylene sulfone, dimethyltetramethylene sulfone. These may be used alone or in combination.

Furthermore, to the organic polar solvent may be added, alone or in combination, a phenol such as cresol, phenol or xylenol; benzonitrile, dioxane, butyrolactone, xylene, cyclohexane, hexane, benzene, toluene and the like, but addition of water is not preferred. That is, since polyamidic acid is hydrolyzed to result in a low-molecular weight one by the action of water present, synthesis of polyamidic acid should be carried out under substantially anhydrous conditions.

The polyamidic acid can be obtained by reacting the tetracarboxylic dianhydride (a) with the diamine (b) in the organic polar solvent.

In the present embodiments, the polyimide resins whose repeating unit are represented by the following structural formula, but the present invention is not limited to the embodiments.

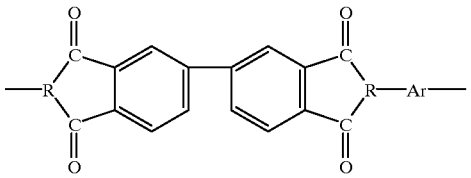

As a method of preparing films of the two-layered belt, on an inner surface of a cylinder having such an inner diameter that the length of outer circumference of the transfer belt 71 and shrinkage in forming film are considered is first formed a surface layer 71*a* with a polyimide whose surface resistivity is adjusted to the range from $10^{11}$ Ω/□ or more to less than $10^{15}$ Ω/□, by the so-called centrifugal molding method, and then on the resulting polyimide surface is further formed a back layer 71*b* with a polyimide using no resistivity adjusting agent by the same centrifugal molding method. After formation of the two layers has been completed, burning at a high temperature, i.e., 350° C. or higher finally affords the transfer belt 71. Thus, since the surface layer and the back layer are formed with the same polyimide, the bonding is strengthened each other to effectively prevent the occurrence of image defects through separation of the two layers with the passage of time.

Moreover, it is preferred to prepare each layer of the two layered belt, especially the back layer 71*b* so that it has a film thickness of the value mentioned below. Namely, the back layer 71*b* is preferably prepared at a film thickness of about 20 to 200 μm. Preferred is a film thickness of 30 to 50 μm. The following is the reason. In forming the belt according to the above method, a small amount of rubbish G (dust etc.) present in the atmosphere is mixed into the back layer 71*b*, and the rubbish G mixed into the film is finally oxidized and carbonized in burning at a high temperature, whereby the resistivity is reduced. As a result, an insulation performance of only the portion at which the rubbish G is present is to be deteriorated Various sizes of rubbish G are present in the atmosphere, but most of the sizes of the rubbish G mixed into the belt in the formation of such belt ranges from about 10 to 20 μm. It is easy to remove the one having a size of larger than 20 μm by changing the atmosphere to the so-called simple clean room. By the way, clean room is a special room in which amount of dust is reduced by circulating the air passed through a filter. The value indicating degree of cleanness of the clean room where centrifugal molding apparatus for forming the present transfer belt, i.e., class (number of dust of 0.5 μm size present in one cubic feet, i.e., about 28.3 liter) is preferably not more than 100,000.

Figure 6:
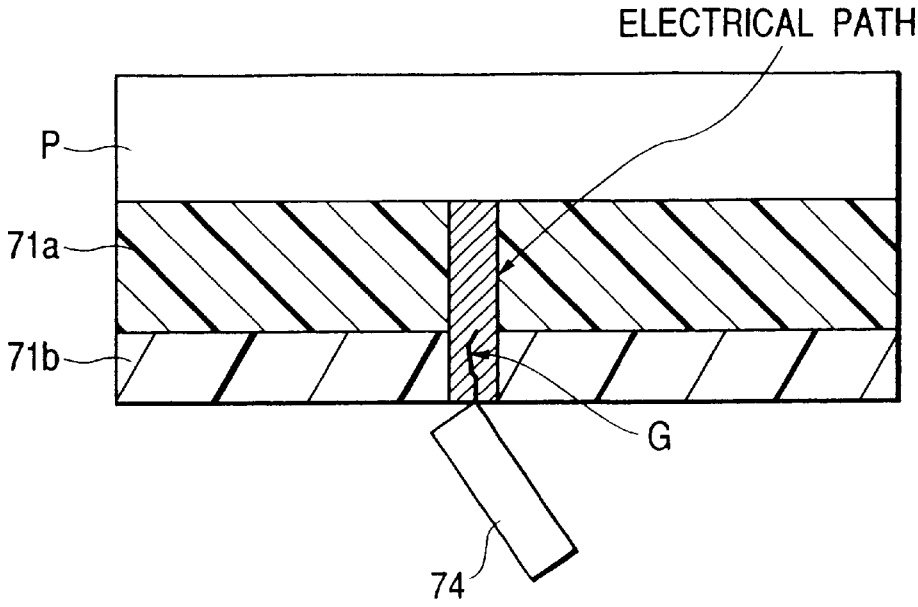
FIG. 6 is a mimetic diagram showing an effect of rubbish mingled in a recording material bearing member.

Referring to FIG. 6, there is shown a cross section of a two-layer belt made of a back layer 71*b* having a film thickness of 20 μm and a surface layer 71*a* having a film thickness of 30 μm. As shown in FIG. 6, if the film thickness of the back layer 71*b* is lower than about 20 μm, only the portion in which rubbish G is mixed loses insulation performance of the back layer 71*b* and then an electrical path appears in a portion between the transfer charging blade 74 and the surface layer 71*a* whose resistance is adjusted to a medium resistance, in other words, in a portion between the contact-type transfer charging blade 74 and the recording material P borne by the transfer belt 71, by which the resistance of this portion is extremely lower than that of the surrounding portion, leading to extremely different transfer performance from those of the surrounding portion on the image transfer, thereby causing poor transferring having a dotted area.

Figure 7:
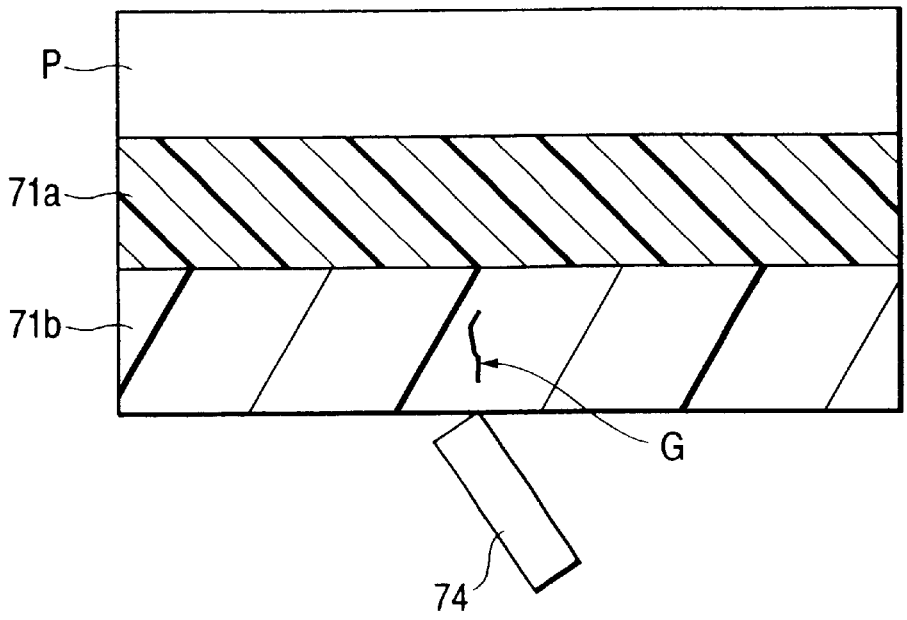
FIG. 7 is a mimetic diagram showing an effect of rubbish mingled in the recording material bearing member.

Next, referring to FIG. 7, there is shown a cross section of a two-layer belt made of a back layer 71*b* having a film thickness of 40 μm and a surface layer 71*a* having a film thickness of 30 μm. As shown in FIG. 7, by forming the back layer 71*b* having a film thickness of more than about 20 μm, it is prevented for the insulation performance of the back layer 71*b* from being completely lost even if rubbish G is mixed so as to prevent an occurrence of an electrical path between the transfer charger (the transfer charging blade 74) and the surface layer 71*a* whose resistance is adjusted to the medium resistance, in other words, between the transfer charger and the recording material P borne by the transfer belt 71. As a result, the resistance,in this portion in which the rubbish G is mixed is not extremely lower than the surrounding portion, by which it becomes possible to prevent poor transferring with dotted area due to extremely different transfer performance from those of the surrounding portion on the image transfer.

In addition, preferably the layer has a film thickness of at least 20 μm from a viewpoint of producing a layer without a pin hole or other defects in the film formation, and it is preferable that the layer has a 30 μm or greater film thickness taking into consideration the above rubbish problem.

On the other hand, thicker the film thickness of the back layer 71*b* which is an insulating member is, higher an electrical load, in other words, an impedance is, which forces a high-voltage output from the transfer power supply to be large. Generally to prevent a leakage to surrounding members or abnormal discharge in a relatively simple method, this high-voltage output is preferably almost 10 kV or lower and preferably the back layer 71*b* having insulating performance has the film thickness of 200 μm or less in order to keep a level lower than the 10 kV output. Preferably the film thickness of the back layer 71*b* is 50 μm or less.

Subsequently, the surface layer 71*a* is required to have a film thickness of at least 20 μm for a reason that a stable film formation is obtained as described in the description of the back layer 71*b*. In addition, to obtain the transfer performance described below stably, the film thickness is required to be kept at 200 μm or less. If the film is too thick, the transfer electric field extends too widely in both upstream and downstream directions of the transfer nip in the medium-resistance layer portion, by which a gap electric discharge easily occurs in the upstream of the transfer nip, thereby causing a poor image such as poor transferring caused by scattering or abnormal electric discharging. Therefore, the film thickness of the surface layer 71*a* is preferably 30 to 50 μm.

Figure 8:
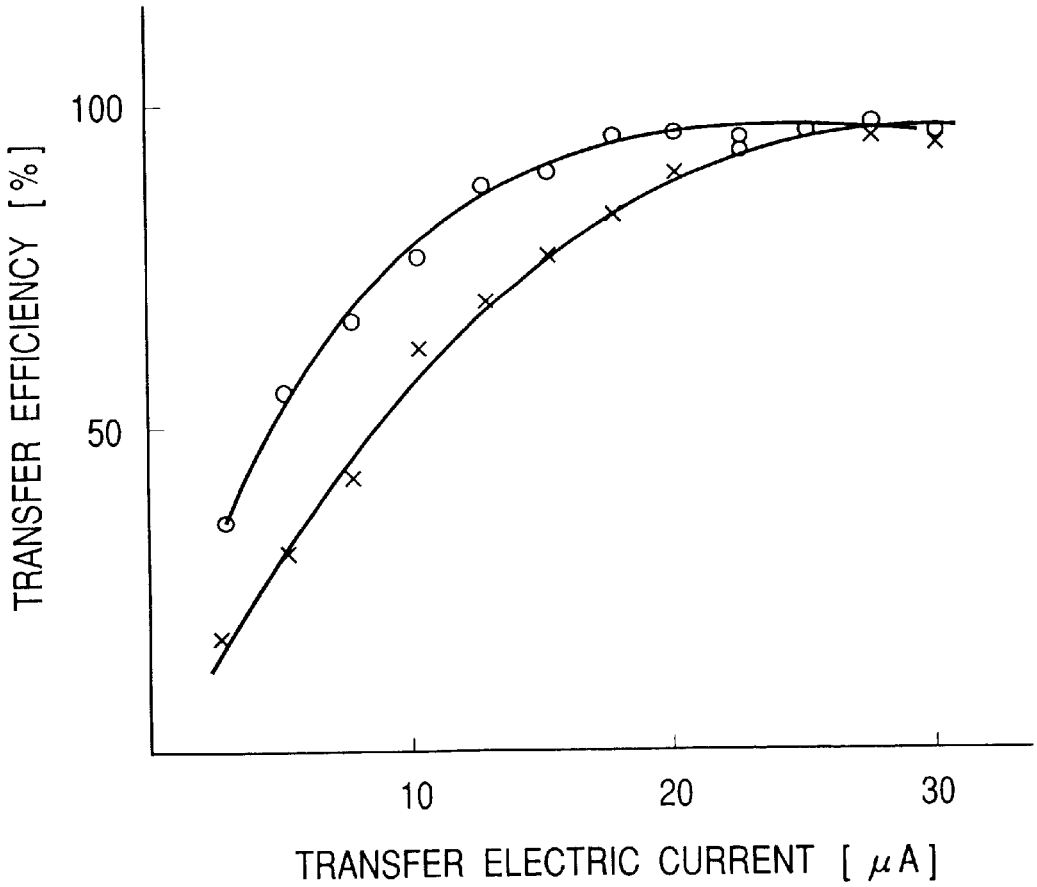
FIG. 8 is a diagram showing a relationship between transfer electric current and transfer efficiency.

Next, a research result of transfer performance by the applicants of this invention will be described below for a case of using the transfer belt 71 having the two-layer configuration. Referring to FIG. 8, there is shown a relationship between a transfer charging bias (transfer current) applied to the transfer charger and a transfer ratio of the developing toner on the photosensitive drum 1 to the recording material, in other words, a transfer efficiency under a low-humidity environment, specifically under an environment of a 23° C./5% humidity or a 0.8 g/kg absolute moisture content. At this point, the toner developed on the photosensitive drum 1 has a charged amount per unit weight is approx. −30 mC/kg and a bearing amount per unit area is 8 g/m$^2$. In FIG. 8, marks ○ plotted in the graph represent characteristics of the transfer efficiency versus the transfer electric current obtained by using the two-layer transfer belt 71 of the present invention, in which the transfer efficiency exceeds 95% at the time when the transfer current has reached approx. 18 $\mu$A, by which the transfer efficiency is saturated. The reason why the transfer efficiency is saturated at 95% seems to be that the residual 5% toner is not attracted to the photosensitive drum 1 by an electrostatic force, but by a non-electrical force such as a Van der Waals force. On the other hand, marks x plotted in FIG. 8 represent characteristics of the transfer efficiency versus the transfer electric current obtained by using a single-layer transfer belt shown in the conventional example having a high resistance, in which the transfer efficiency exceeds 95% at the time when the transfer current has reached approx. 25 $\mu$A, by which the transfer efficiency is saturated. Therefore, comparing the transfer current needed for the saturation of the transfer efficiency, the two-layer transfer belt used in this embodiment provides a sufficient toner transfer at a current output obtained from an equation 18÷25=0.72, i.e., the current output of 72% in comparison with the conventionally used transfer belt having a high resistance.

The reason why the required transfer current can be reduced as described above seems to be as described below. Since the surface resistivity in the recording material abutment side of the transfer belt 71 is set to $10^{11}$ Ω/□ or higher and less than $10^{15}$ Ω/□ and therefore a substantial transfer charging nip (effective transfer area) is expanded, thereby substantially gaining time for the transfer charging. It should be noted that, however, the effective transfer area is preferably included in the area of a contact portion between the photosensitive member and the recording material in order to prevent discharging or toner scattering (the same length is possible).

As a method of validating whether or not the effective transfer area is included in the contact area between the photosensitive member and the recording material, the following method is used. First, a solid image is formed on the photosensitive member. Subsequently the photosensitive member is rotated so that the solid image is opposed to the transfer portion and then stopped. Next, in a condition that the recording material attracted to the transfer belt is opposite to the above transfer portion, the transfer belt is moved toward the photosensitive body in the same manner as for the normal transfer operation. In this state, the transfer voltage is applied to the transfer blade and then a length (in a conveying direction of the recording material) of the toner image transferred to the recording material is measured. The validation is achieved by comparing this length with the previously measured length of the contact area between the photosensitive member and the recording material In this embodiment, under a low-humidity environment or in a mode for forming an image on both sides of the recording material, a transfer electric field (voltage) required for the transfer can be reduced during an image formation on the second surface (the reverse surface to the first surface) of the recording material which has passed the fixing device once to fix the toner image to the first surface of the recording material and an occurrence of a local abnormal electric discharge can be suppressed, thereby achieving a good image formation without poor transferring. While the resistance on the recording material bearing side of the transfer belt is lowered to the medium level, the transfer charger side of the transfer belt is maintained to be at a high resistance, by which it becomes possible to prevent attraction or conveyance problems of the recording material which may occur at a medium resistance or a low resistance of the entire transfer belt, poor transferring problems which may be caused by electric interference, and poor image problems which may occur during passing of a recording material shorter in the widthwise direction of the transfer belt.

Furthermore, the high-resistance layer has a film thickness of 20 $\mu$m or greater In the transfer charger side, by which it becomes possible to prevent the insulation performance from being reduced by a rubbish mixed in film formation, and therefore the above good image formation can be achieved with preventing the occurrences of poor transferring caused by these rubbish problems.

In this embodiment, as the surface layer 71*a* of the transfer belt 71, a polyimide resin in which carbon black is dispersed is employed, the thickness being 35 $\mu$m, and the surface resistivity is adjusted to $10^{13}$ Ω/□. The back layer 71*b* has a thickness of 40 $\mu$m and is composed of an insulating layer of a polyimide resin containing no resistivity adjusting agent, whose surface resistivity is $10^{15}$ Ω/□. According to the above-mentioned method, each layer is piled in the stage of a polyimide precursor (polyamide resin), and then imidated and shaped into one united body. A material for the transfer belt 71 is not limited to a polyimide resin but, other than the resin, a plastic such as a polycarbonate resin, a polyethylene terephthalate resin, a polyvinylidene fluoride resin, a polyethylene naphthalate resin, a polyether ether ketone resin, a polyether sulfone resin, a polyurethane resin, and a rubber of fluoro-type or silicone-type are preferably employed.

Furthermore, as the transfer charging blade 74, the one having a volume resistivity of $1\times10^5$ to $1\times10^7$ Ωcm, a blade thickness of 2 mm, and a length (thrust width) of 306 mm has been employed. In the present example, transfer has been carried out under a constant-current controlling of a current of 15 $\mu$A applied to the transfer charging blade 74 with using a constant-current power supply as the power source.

A toner image thus formed on a photosensitive member 1 is transferred onto a recording member P by the transfer charging blade 74. Further, the transfer belt 71 also acts as conveying means of the recording material P from a transfer nip portion 70 to a fixing device 6, so that the recording material P passed through the transfer nip potion 70 is separated from the surface of the photosensitive member 1 and conveyed to the fixing device 6 by the transfer belt 71.

Next, an operation of the above image forming apparatus is described below.

In an image formation, the photosensitive member 1 is driven to rotate in a direction indicated by an arrow A by driving means (not shown) and its surface is uniformly charged by the magnetic brush 2. Then, an image exposure is applied to the charged photosensitive member 1 by an exposing device (LED scanning device) 3 to form an electrostatic latent image corresponding to inputted image information and this electrostatic latent image is developed as a toner image by the developing device 4. When the toner image on the photosensitive member 1 reaches the transfer nip portion 70 between the photosensitive member 1 and the transfer belt 71 of the transfer device, the recording material P such as paper in a cassette 80 is fed by a feeding roller 81 at the timing so as to be conveyed by a registration roller 82, charges having an opposite polarity to a polarity of the toner t are supplied to the back side of the recording material P by the transfer charging blade 74 to which a transfer bias is applied, and then the toner image on the photosensitive member 1 is transferred to the front surface of the recording material P. Subsequently, the recording material P to which the toner image has been transferred is conveyed to the fixing device 6 by the transfer belt 71 and the toner image is fixed as a permanent fixed image to the surface of the recording material and then ejected. On the other hand, the transfer belt 71 from which the recording material P has been separated is submitted to an elimination of the charges on both surfaces of the belt by using a pair of a transfer belt charge-eliminator 10 comprising a grounded conductive fur brush and a grounded transfer belt driving roller and to a removal of foreign substances such as residual toner or paper dust on the surface of the belt by using a transfer belt cleaner 11 comprising a cleaning blade 20 made of urethane rubber for a preparation for the next image formation.

In this embodiment, an abutment pressure (counter abutment) of the cleaning blade 20 is within a range of the lower limit 400 g to the upper limit 1,500 g in total.

In other words, poor cleaning occurs if the abutment pressure is less than 400 g or more than 1,500 g.

This is because the abutment pressure of less than 400 g is insufficient and that of more than 1,500 g causes an abdominal abutment, by which an edge of the cleaning blade 20 does not abut on the transfer belt.

The constitution for the cleaning is determined as described below. First, a target value is determined according to a type of toner to be cleaned and an amount of toner to be cleaned at a time, before the cleaning constitution is determined for cleaning this toner. Therefore, 7 $\mu$m toner is used in this embodiment.

In addition, in the constitution which has been applied, the transfer belt 71 can be completely cleaned after an image is directly formed on the transfer belt 71 using 0.7 mg/cm$^2$ of toner amount in an area equivalent to size A3.

There can be this condition if an image is formed while a recording material is not conveyed due to paper jamming or the like.

Therefore, preferably the abutment pressure is further increased if 6 $\mu$m toner is used and the abutment pressure is further increased if the amount of toner to be cleaned is increased. In addition, it is also possible that the hardness of the cleaning blade 20 is increased with a high abutment pressure.

On the other hand, on the photosensitive member 1 after passing the transfer nip 70, there remains a very small amount of toner (transfer residual toner) not completely used up for the transfer onto the recording material in the transfer nip 70. The transfer residual toner is scraped off by the magnetic brush 2 electrostatically and physically to be absorbed by the magnetic brush 2 once. In an inside of the magnetic brush 2, a resistance of the magnetic brush itself is increased when the transfer residual toner is accumulated in the magnetic brush 2, by which the photosensitive member 1 cannot be charged sufficiently. This effect causes an electric potential difference between the magnetic brush 2 and the surface of the photosensitive member 1, by which the transfer residual toner Included in the magnetic brush 2 is electrostatically translocated to the photosensitive member 1. The transfer residual toner translocated to the photosensitive member 1 is electrostatically taken into the developing device 4 to be consumed in the next image formation.

Next, effects of the two-layer transfer belt 71 will be described below.

As already shown in the conventional example, it is important to select a resistance condition of the transfer belt 71 in the image forming apparatus as described in the above, and It has been difficult to obtain resistance conditions satisfying stability in all of the problems described in the conventional example. By applying the two-layer structure having different resistance values to the transfer belt 71 as described in this embodiment, the conveyance of a recording material and the transfer of a toner image can be achieved more stably.

First, regarding the electrostatic attracting conveyance of the recording material, a back layer in the high-resistance side is made of an insulating substance having a relatively high resistivity of approx. $10^{15}$ Ω·cm volume resistivity and of $10^{15}$ Ω·cm in the thickness direction across the two layers, and therefore this transfer belt has an electrostatic attracting force almost equal to an insulating substance. In addition, the surface resistivity on the surface on which the recording material is borne is slightly lower, and therefore a possibility of an abnormal image caused by a separation electric-discharge tends to be reduced in a separation of the recording material from the transfer belt (In the transfer belt in this embodiment, it is preferable to eliminate residual charges actively by using the separation charger 90.).

Next, the transfer performance is significantly improved by using the two-layer transfer belt 71 in this embodiment whose surface layer has a low resistance.

First, the existence of the low-resistance layer on the surface tends to increase an electrical transfer nip. This phenomenon will be described below by referring to FIGS. 9A, 9B, and 9C.

Figure 9A:
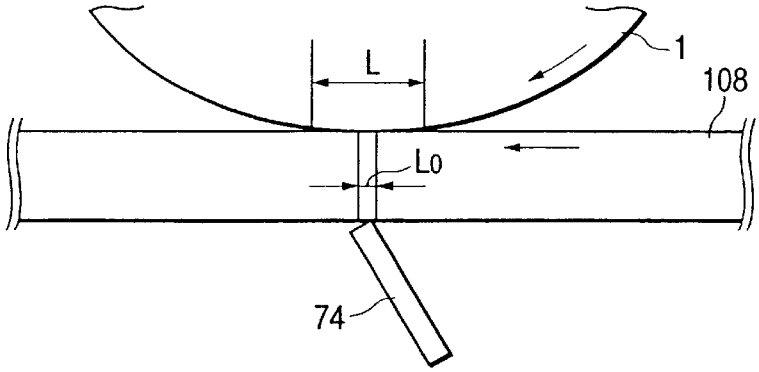
FIGS. 9A, 9B, and 9C are diagrams of assistance in explaining an electrical nip according to the present invention, a conventional example, and a comparative example, respectively.
Figure 9B:
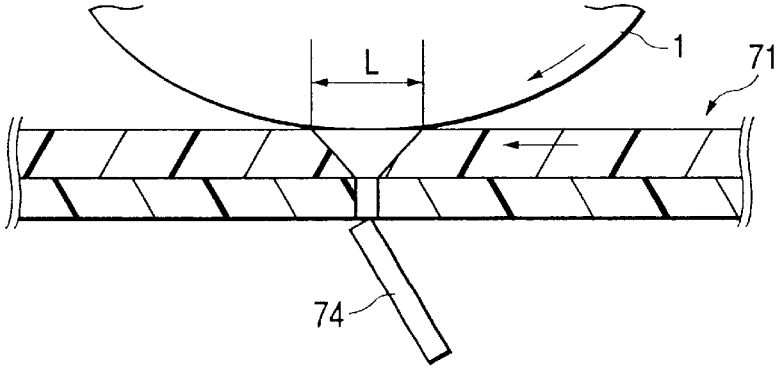
Figure 9C:
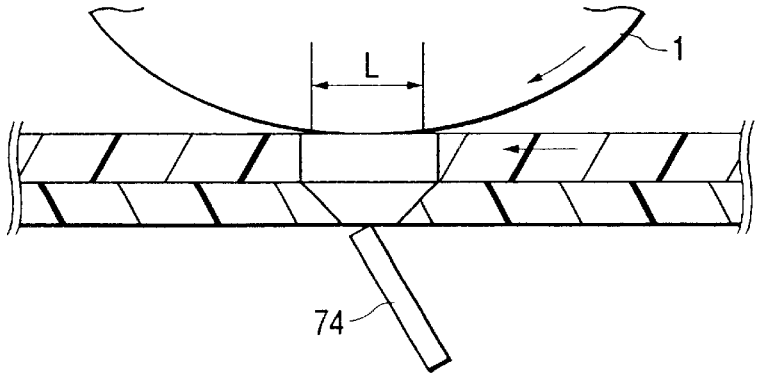

Referring to FIG. 9A, there is shown an example of a use of the conventional single-layer insulating transfer belt 108. An electric field applied by the transfer blade 74 is a narrow range (effective transfer area) such as $L_0$ of an electric field effective to the length L of a contact area between the photosensitive member and the recording material attracted to the transfer belt, with a line of electric force extending toward an aluminum substrate which is the lowest layer of the photosensitive member 1 being grounded. As for the two-layer transfer belt 71 of the present invention with the surface having a low resistance, its effective electric field range, that is, an effective transfer area (hereinafter referred to as an electrical nip) is expanded as shown in FIG. 9B due to the low resistance of the surface. This expansion of the electrical nip elongates the time during which the electric field reaches, by which it becomes possible to transfer a toner image with the same amount of charges by supplying a less amount of charges.

The above phenomenon is likely achieved even if the back surface has a low resistance, in other words, even if a transfer belt (FIG. 9C) in which the front and back sides of the transfer belt 71 introduced in this embodiment are reversed is used instead of the transfer belt 71. When using the low resistance of the back surface against which the transfer blade 74 abuts, however, an electrical nip is expanded at a higher voltage since the low resistance is near the transfer blade 74 connected to the transfer power supply, relative to the transfer belt having the low resistance surface as shown in FIG. 9B in this embodiment. Accordingly, scattering described in the conventional example easily occurs unpreferably.

Furthermore, the description will be given below regarding various problems with the transfer belt resistance as described in the conventional example. First, as for electrical interference in the transfer, the surface and back layers of the transfer belt 71 have relatively high resistances such as the surface resistivity of $10^{13}$ Ω/□ and the surface resistivity of $10^{15}$ Ω/□, respectively. They are sufficiently high particularly in comparison with the surface resistivity $10^9$ to $10^{11}$ Ω/□ of paper as a recording material and therefore there is no problem. Next, regarding a small-size problem, there is a high resistance layer (back layer), by which a resistance It of the transfer belt is sufficiently larger than a resistance Rp of the recording material in the conventional example (equation 3), thereby causing no significant problem.

In addition, regarding the scattering problem, the total resistance of the transfer belt is high in the same manner as for the electrostatic attraction of the recording material, and therefore the charge retaining capacity is sufficiently high, which unlikely lead to the problem.

Finally, regarding the abnormal electric discharge, the transfer-electric field is reduced to the low level as described above, by which an abnormal discharge itself does not easily occur.

The two-layer transfer belt in this-embodiment is compared with the single-layer polyimide resin (hereinafter, referred to as PI) (insulating) transfer belt introduced in the conventional example and with a single-layer polyimide transfer belt (having a volume resistivity of $10^{13}$ Ωcm) whose resistance is controlled by dispersing carbon into the polyimide.

| Belt structure | Electro-static attraction | Required transfer current | Transfer blade applied voltage | Scattering | Abnormal discharge (Poor image) |
|---|---|---|---|---|---|
| insulating PI single-layer belt | ○ | High | High | ○ | x |
| 13th power PI single-layer belt | Δ | Middle | Low | Δ | ○ |
| Two-layer PI belt | ○ | Low | Middle | ○ | ○ |

Marks ○, Δ, and x in the above table mean that there is no problem, that there is a problem within a range of a practical use, and that there is a significant problem, respectively.

As set forth in the above, it is understood that the transfer belt in this embodiment unlikely cause a problem, so that good images can be formed in comparison with the conventional example and with the comparative example.

The surface layer 71*a* may include a fluorine resin by approx. 10% as lubricating filler and the back layer 71*b* may include no lubricating filler. In other words, lubricating filler is included only in the surface layer 71*a*.

Accordingly, the static friction coefficient to metal is 0.2 for a surface of the layer including the fluorine resin by approx. 10% and 0.4 for a surface of the layer not including the lubricating filler. The friction coefficient is lowered by increasing the additive amount of the fluorine resin, while a mechanical strength is decreased by the increase.

The lubricating filler can be a fluorine resin, a silicone resin, a polyolefin resin, or a combination of these resins.

The material of the transfer belt 71 can be aromatic polyamide or aromatic polyimide produced by the same manufacturing method.

Figure 10:
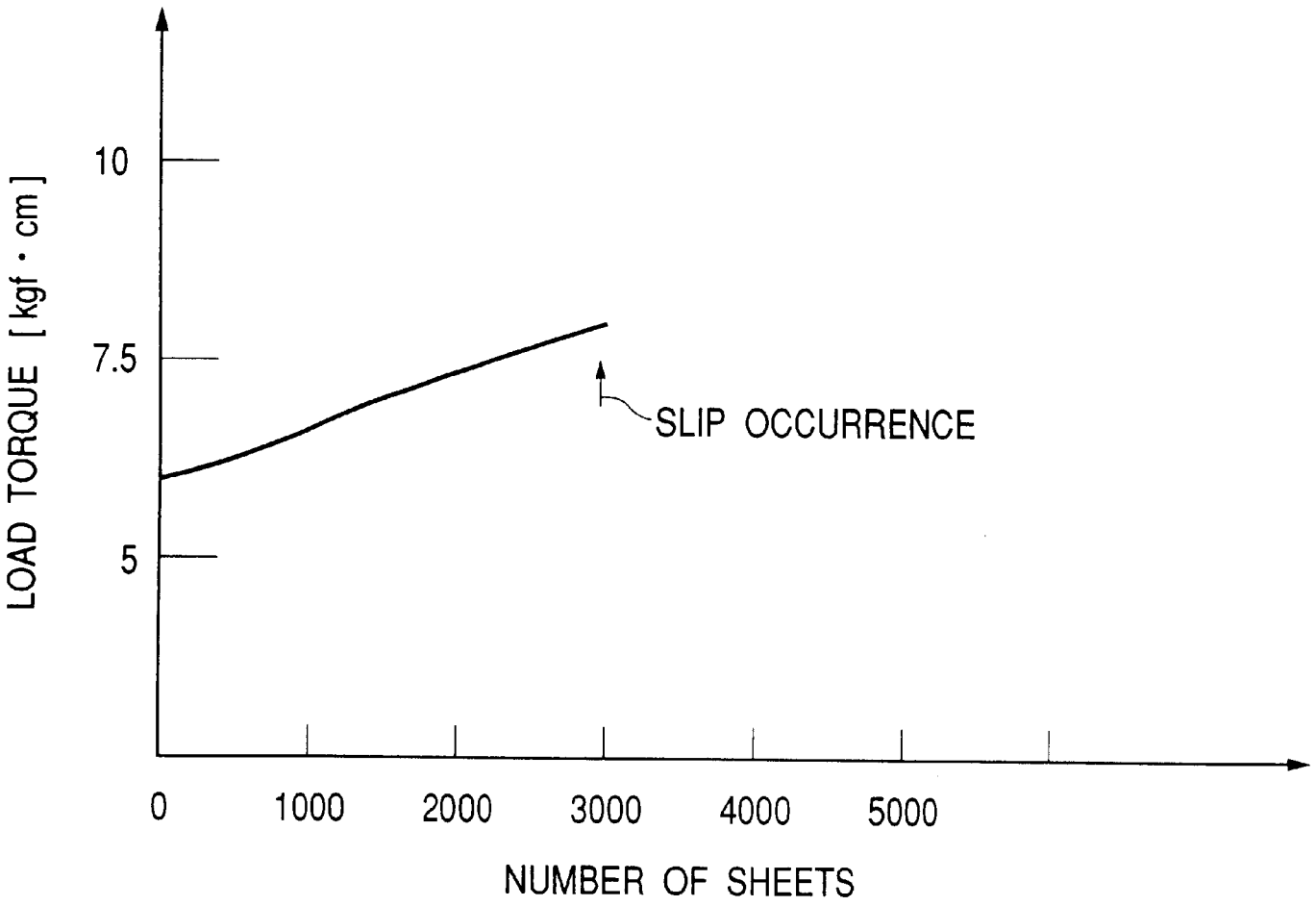
FIG. 10 is a graph of a load torque of a transfer belt In a continuous image formation with a transfer belt having a single-layer configuration and not including a lubricating filler in the conventional image forming apparatus.

FIG. 10 shows a load torque of the transfer belt obtained when an image formation is continuously performed by using a single-layer transfer belt including no lubricating filler as a comparative example to this invention In the above structure.

As shown in FIG. 10, images are formed on about 3,000 sheets and the load reaches approx. 8 kgf·cm (0.78 N·m), thereby causing a slip of the driving roller 72 for transmitting a rotation driving force to the transfer belt 71.

Therefore, the above two-layer transfer belt 71 characterizing the present invention is used for an experiment, in which no slip occurs after images are formed on 50,000 sheets.

On the other hand, as a result of investigating a transition of the load torque at endurance, the load torque is approx. 6 kgf·cm (0.59 N·m) initially and increased as the endurance condition is continued to approx. 7 kgf·cm (0.69 N·m) after the image formation on 50,000 sheets.

In addition, there is no portion where two layers are peeled off each other and there is no poor development on the Image in the same manner as for the initial state.

Therefore, the life of the transfer belt 71 is determined to be a period equivalent to 50,000 sheets and the transfer belt is to be replaced with new one as a replacement part. The toner fusion bond phenomenon depends upon a scattering state of a developing material or a abutment condition of the cleaning blade 20, and therefore the life of the transfer belt 71 also changes according to these configurations.

As described above, in this embodiment, lubricating filler is included in the layer of the transfer belt 71 on which the cleaning blade 20 abuts, by which a friction force between the cleaning blade 20 and the transfer belt 71 is decreased, and therefore it is possible to provide an image forming apparatus without slip occurrences between the transfer belt 71 and the driving roller 72.

Second Embodiment

A second embodiment will be described below. The constitution of this embodiment is almost the same as that of the first embodiment, except that a transfer belt is abraded by using an abrasive roller. Therefore, a detailed description is omitted here.

Figure 11:
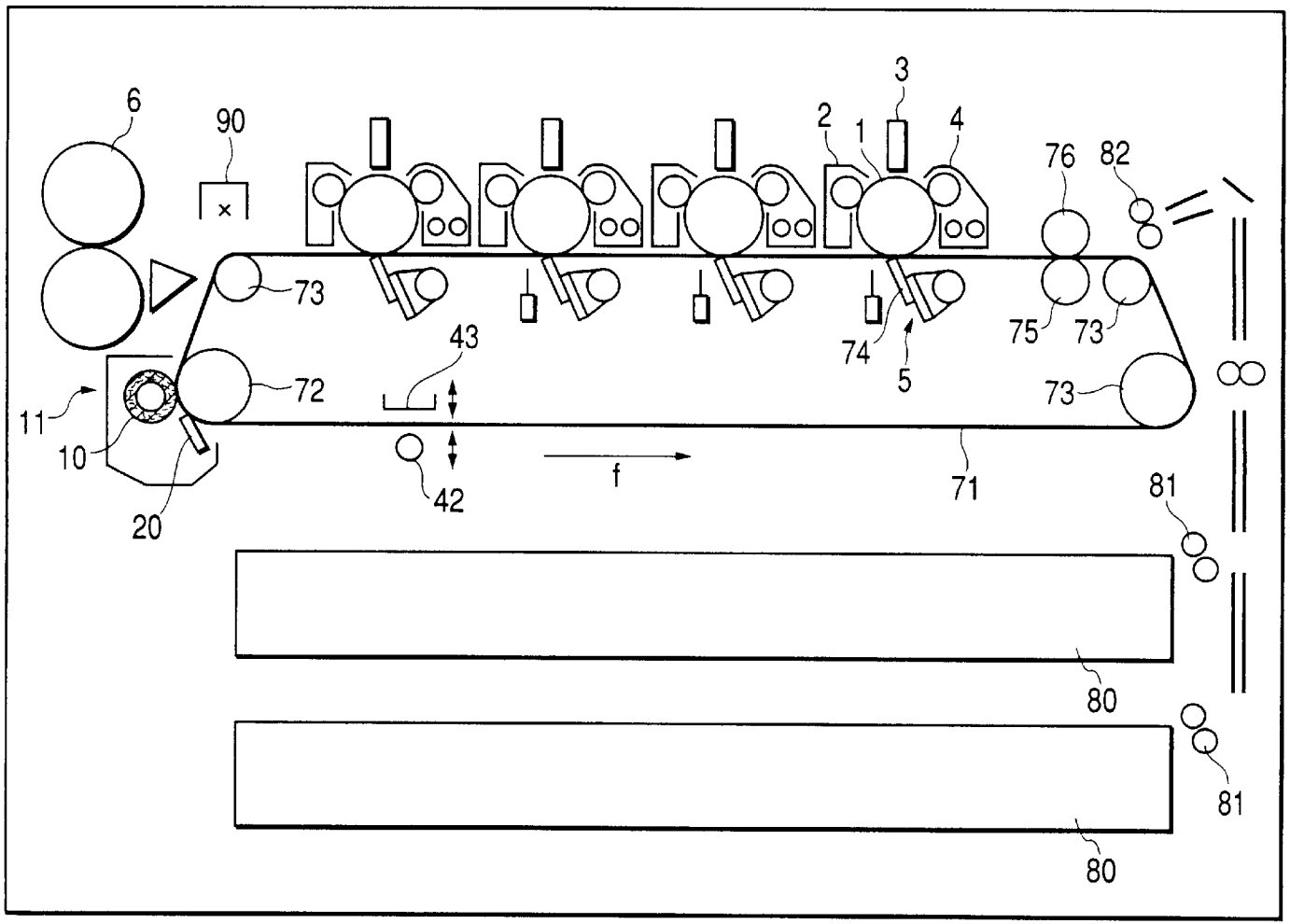
FIG. 11 is a schematic diagram showing an image forming apparatus according to a second embodiment.

As shown in FIG. 11, there is arranged an abrasive roller 42 as abrasive means opposite to an opposing member 43 for the transfer belt 71 as a recording material bearing member in this embodiment.

By using this abrasive roller 42, toner or paper dust firmly adhered to the transfer belt can be removed so as to refresh the surface layer 71*a* of the transfer belt.

The abrasive roller moves or slides in a direction opposite to (counter to) the moving direction of the transfer belt in the abutment position. Whenever images are formed on 10,000 sheets of a recording material in total, for example, the abrasive roller is operated. In other words, the abrasive roller 42 and the opposing member 43 are spaced from the transfer belt during the normal image formation, while the abrasive roller abuts on the transfer belt to be driven to rotate and the opposing member 43 abuts on the transfer belt during operation.

As set forth in the above, fusion bond of toner or paper dust adhered to the transfer belt surface layer 71*a* decreases the effect of adding the lubricating filler by 10% into the surface layer 71*a* (the lubricating filler is not included in the back layer). If taking a countermeasure for this problem by abrading the surface, a resistance value is changed by a change of the thickness of the transfer belt 71, which may cause a new problem such as poor image or poor transferring. In this embodiment, however, there is provided the two-layer transfer belt in which an electric resistivity (volume resistivity and surface resistivity) of the surface layer 71*a* is lower than the electric resistivity (volume resistivity and surface resistivity) of the back layer 71*b*, by which it is possible to avoid the above poor image even if the thickness of the surface layer changes to some extent.

Furthermore, the abrasive roller 42 used in this embodiment comprises a 20 mm diameter metal roller around which a wrapping film (a resin sheet to which alumina agent as abrasive is bonded) is wound. In this embodiment, is used a wrapping film #320 made by Sumitomo 3M Ltd.

The abutment pressure is assumed to be 1,000 g in total. The abutment operation is performed for about 3 minutes on the rotating transfer belt while an image forming operation is stopped to remove the fusion bond toner and paper dust on the transfer belt 71.

As a result of operating the abrasive roller 42 by using the above transfer belt 71, a ten-point-average roughness Rz becomes approx. 3 $\mu$m on the surface of the transfer belt 71 at a single-time operation. Therefore, the abrasive roller 42 and the opposing member 43 are operated once per image formation on 10,000 sheets in this configuration.

As a result of investigating a transition of the load torque in endurance in the above configuration, the load torque is approx. 5.5 kgf·cm initially. After the image formation on 10,000 sheets, the load torque before abrading the transfer belt 130 is approx. 6.3 kgf·cm and then the load torque returns to approx. 5.5 kgf·cm after an operation of the abrasive roller 42.

The load torque after the image formation on 100,000 sheets is approx. 6.5 kgf·cm and the transfer belt 71 is approx. 45 $\mu$m in the film thickness at this point. This is because the surface layer is abraded by the abrasive roller 42.

In the transfer belt 71, the volume resistivity of the two layers in total is approx. $10^{15}$ Ωcm, which remains the same as one in the initial state.

In addition, there is no portion where two layers are peeled off each other and there is no poor image in the same manner as for the initial state. Therefore, the life of the transfer belt 71 is determined to be a period equivalent to 100,000 sheets.

The toner fusion bond phenomenon depends upon a scattering state of toner in the developer container or a abutment condition or the like of the cleaning blade 20 as a cleaning member for the transfer belt, and therefore the life of the transfer belt 71 also changes according to these configurations.

The resistance value (volume resistivity, surface resistivity) of the surface layer is preferably smaller than that of the back layer by two digits or more.

Figure 12:
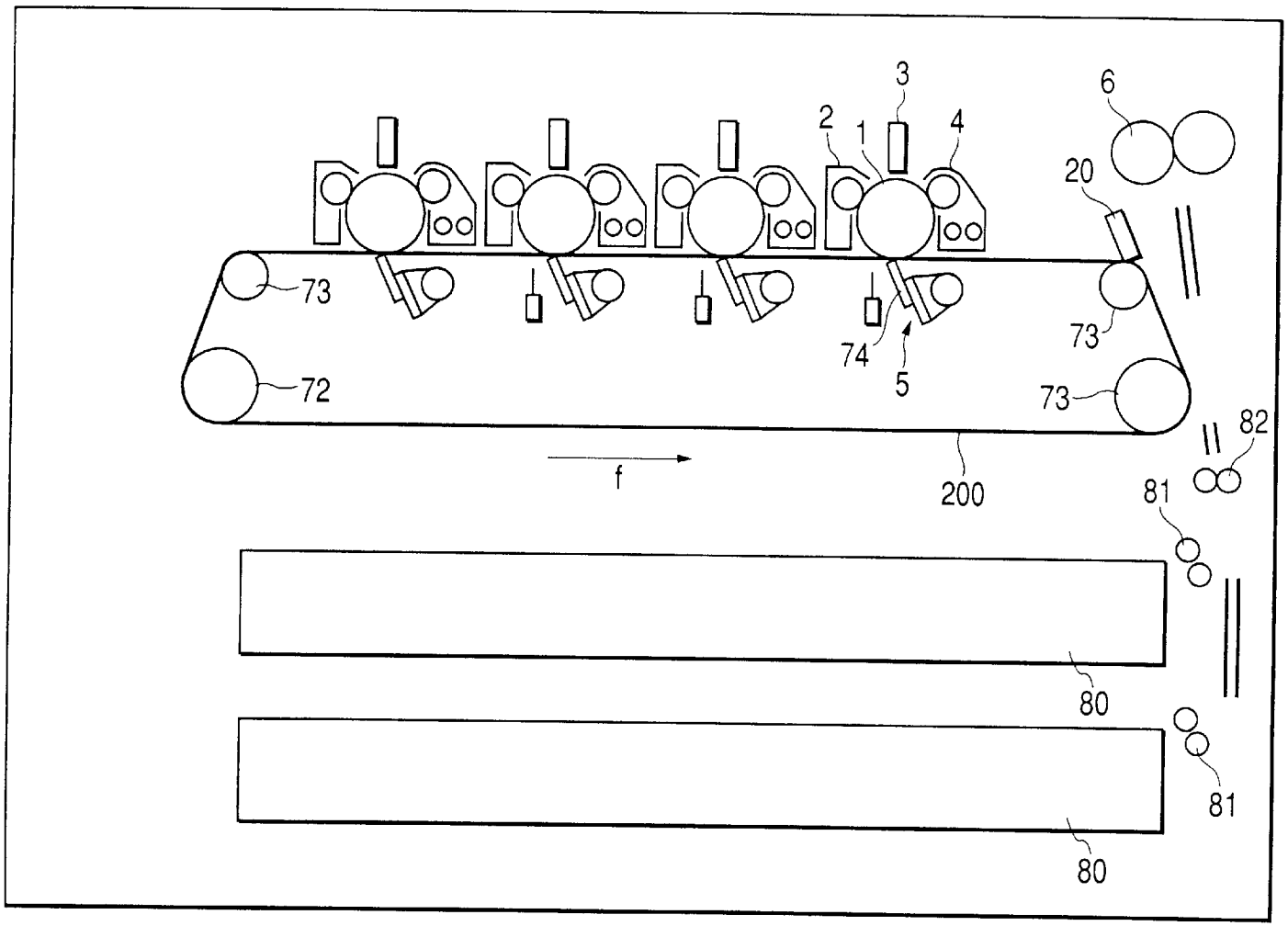
FIG. 12 is a schematic diagram showing another applicative example of the present invention.

While this embodiment shows an example of a color printer or copying machine, a monochrome printer or copying machine is applicable. In addition, an analog type copying machine is also applicable. Furthermore, in the present invention, it is possible to use not a transfer belt for transferring a toner image directly to a recording material, but an intermediate transfer belt 200 in an intermediate transfer method in which an intermediate transfer member as shown in FIG. 12 is used to primarily transfer the toner image on the photosensitive member to the intermediate transfer member once and then to secondarily transfer the toner image to the recording material, instead of the above transfer belt 71.

As set forth in the above, in the image forming apparatus according to the present invention, lubricating filler is included in the layer on which the cleaning blade 20 for the transfer belt 71 abuts, thereby decreasing a friction force between the cleaning blade 20 and the transfer belt 71, by which it is possible to provide an image forming apparatus not causing a slip between the transfer belt 71 and the driving roller 72 and further it is possible to provide an image forming apparatus not causing poor images. without any change in the entire volume resistivity of the transfer belt 71 even if the surface of the transfer belt 71 is abraded.

In addition, the same material is used as a base for both layers forming the transfer belt 71, by which it is possible to provide an image forming apparatus free from occurrences of peeling off or air gaps after a use for a long period.

Figure 13:
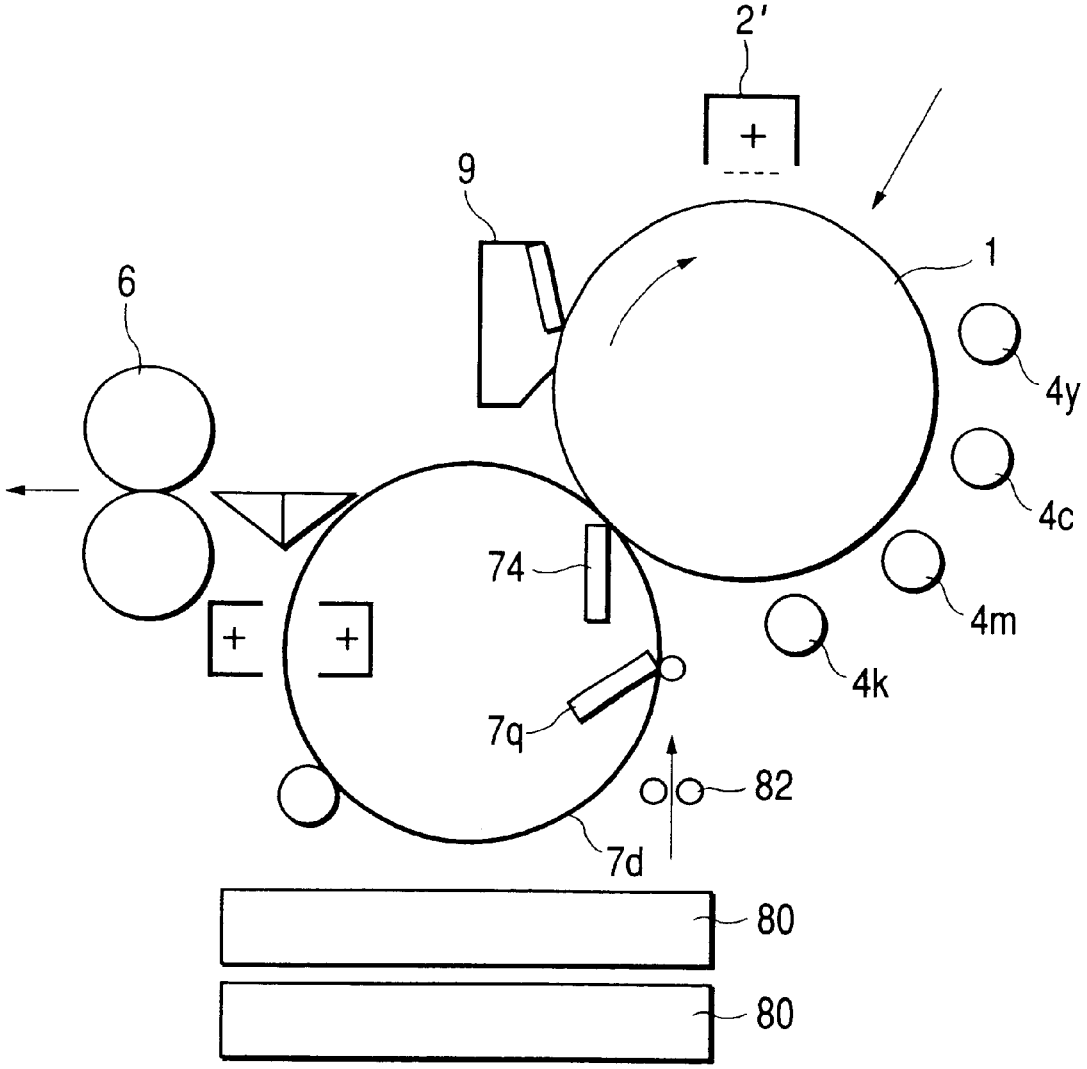
FIG. 13 is a schematic diagram showing still another applicative example of the present invention.
Figure 14:
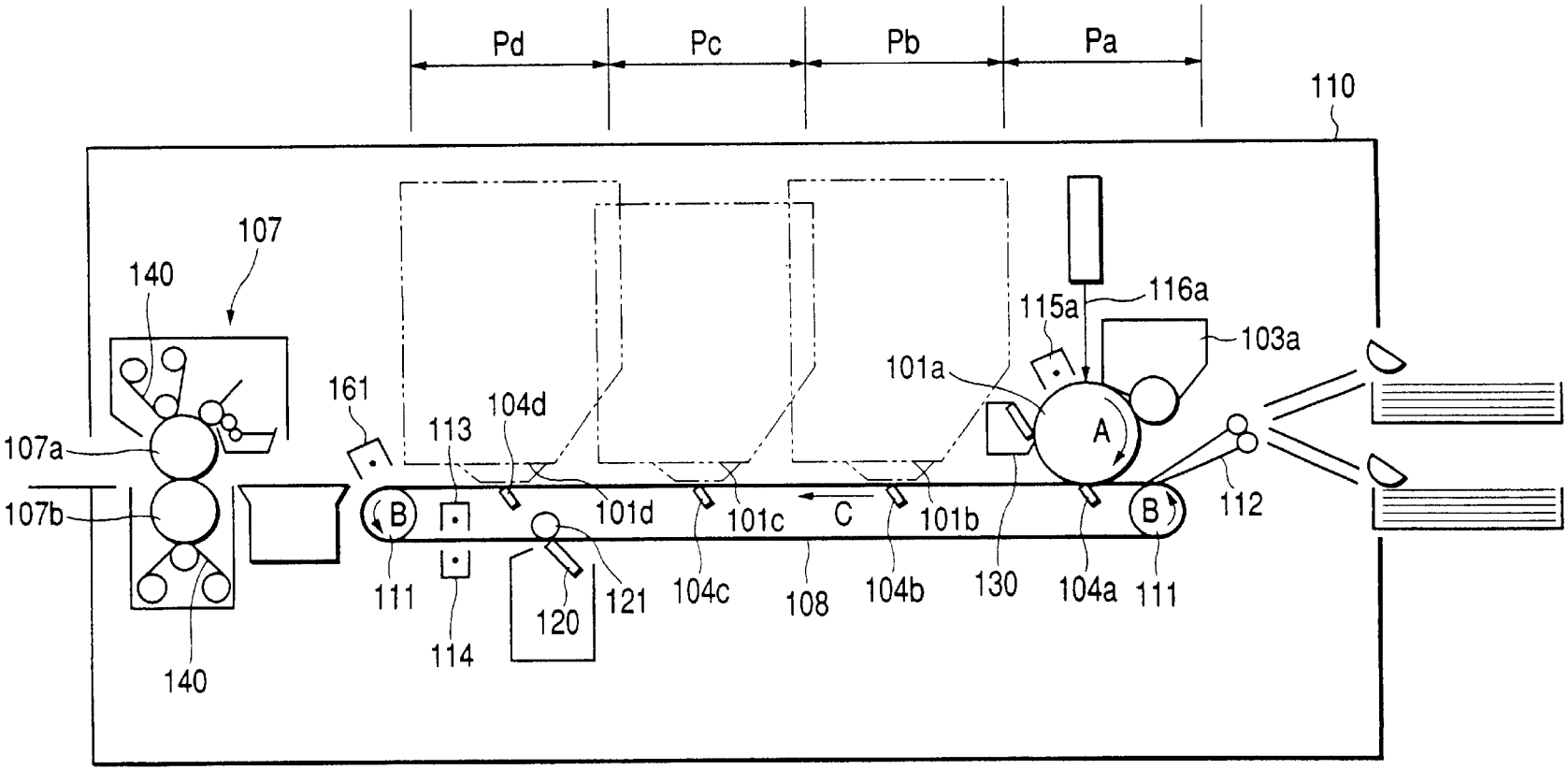
FIG. 14 PRIOR ART
FIG. 14 is a schematic diagram showing a conventional image forming apparatus.
Figure 15:
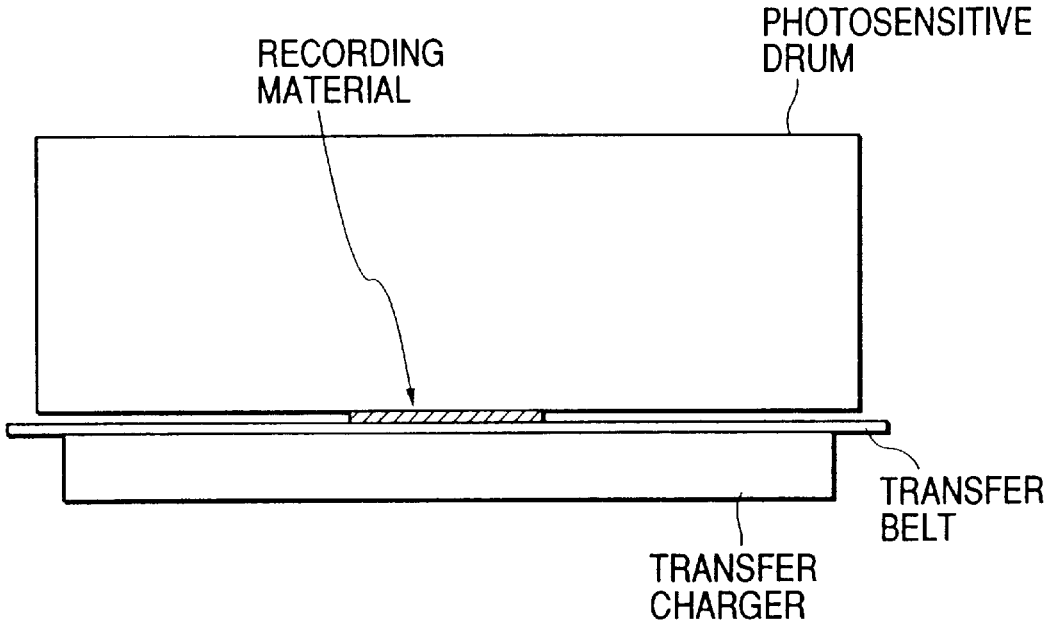
FIG. 15 PRIOR ART
FIG. 15 is a schematic diagram of assistance in explaining a conventional problem.

While there has been described above an image forming apparatus with a transfer belt as a recording material bearing member in the above embodiment, it will be appreciated that the invention is not limited thereto, and the present invention is also applicable to an image forming apparatus with a transfer drum as shown in FIG. 13.

In other words, the same effect is achieved also in the image forming apparatus in which toner images having different colors are formed sequentially on a single photosensitive member and then the toner images are sequentially transferred to the recording material electrostatically attracted onto the transfer drum as shown in FIG. 13.

In FIG. 13, there are arranged a primary charger 2' as charging means, an exposing device (not shown), a group of developing devices 4, and a cleaner 9 around the photosensitive member 1 as an image bearing member. The group of the developing devices 4 includes a magenta developing device **4*m*, a cyan developing device 4*c*, an yellow developing device 4*y*, and a black developing device 4*k*. Diagonally below the photosensitive member 1, there is arranged a transfer drum 7*d* around which the transfer belt as a recording material bearing member is stretched in a cylindrical shape. Inside the transfer drum 7*d*, there are arranged an attracting charging blade 7*q* and a transfer charging blade 74. To this transfer drum 7*d* the recording material is conveyed via a registration roller 82 or the like from a recording material cassette 80 installed in the bottom of the apparatus body. In the recording material bearing portion of the transfer drum 7*d* also in this embodiment, is used a transfer belt comprising two layers such as a 35 $\mu$m thickness whose resistance is adjusted to a $10^{13}$ Ω/□ surface resistivity by dispersing carbon black in the recording material bearing surface and a 40 $\mu$m thickness layer made of an insulating polyimide on a surface in contact with the attracting charger or a transfer charger. In the image forming apparatus having this configuration, an electrostatic attraction is performed not in a planar portion as shown in the first and second embodiments, but in a curved surface portion of the transfer drum 7*d*. Therefore, if a hard recording material such as a cardboard is used, a stronger electrostatic attracting force is required. In the transfer drum 7*d*** in this configuration, however, good images can be formed without making a sacrifice of the electrostatic attracting force as described above and without any problems such as abnormal electric discharging likely caused by using a transfer drum having a high resistance.

Furthermore, it becomes possible to prevent poor transferring from being caused by a rubbish mixed in film formation in the same manner as the first and second embodiments and to prevent poor transferring from being caused under a low humidity environment or by local abnormal discharging which may occur in an image formation on the second surface of a recording material in a two-sided image formation, thereby enabling good image formation.

What is claimed is:

1. An image forming apparatus, comprising:

an image bearing member for bearing an image;

a recording material bearing member for bearing a recording material electrostatically; and transfer means for transferring the image on said image bearing member electrostatically to the recording material borne by said recording material bearing member by being brought into contact with said recording material bearing member, wherein a length of a contact area between said recording material bearing member and said transfer means is less than that of a contact area between said image beating member and said recording material borne by said recording material bearing member in a movement direction of said recording material bearing member, wherein said recording material bearing member comprises a first layer for bearing the recording material and a second layer in contact with said transfer means on an image transfer, and wherein a surface resistivity of said first layer is lower than a surface resistivity of said second layer.

2. A image forming apparatus according to claim 1, wherein the length of the contact area between said recording material bearing member and said transfer means is 0.3 to 1.5 mm in the movement direction of said recording material bearing member.

3. An image forming apparatus according to claim 2, wherein said transfer means comprises a plate-shaped transfer member brought into contact with said recording material bearing member on the image transfer.

4. An image forming apparatus according to claim 3, wherein only a portion in the vicinity of an edge portion of said plate-shaped transfer member is brought into contact with said recording material bearing member.

5. An image forming apparatus according to claim 4, wherein electric current flows in said transfer member is controlled to be constant current.

6. An image forming apparatus according to claim 1, wherein a thickness of said second layer is 20 to 200 $\mu$m.

7. An image forming apparatus according to claim 6, wherein said recording material bearing member is formed by forming said second layer on said first layer by using a centrifugal molding device and then heating said first and second layers.

8. An image forming apparatus according to claim 7, wherein said second layer is formed by said centrifugal molding device arranged in a clean room.

9. An image forming apparatus according to claim 1, wherein said second layer has a thickness of 30 to 50 $\mu$m.

10. An image forming apparatus according to claim 9, wherein said recording material bearing member is formed by forming said second layer on said first layer by using a centrifugal molding device and then heating said first and second layers.

11. An image forming apparatus according to claim 10, wherein said second layer is formed by said centrifugal molding device arranged in a clean room.

12. An image forming apparatus according to claim 1, wherein said recording material bearing member comprises only said first and second layers.

13. An image forming apparatus according to claim 1, wherein a length of an effective transfer area of aid transfer means is equal to or less than the length of the contact area between said image bearing member and said recording material borne by said recording material bearing member in the movement direction of said recording material bearing member.

14. An image forming apparatus according to claim 13, wherein the effective transfer area of said transfer means is included in the contact area between said image bearing member and the recording material borne by said recording material bearing member.

15. An image forming apparatus according to claim 1, wherein the contact area between said recording material bearing member and said transfer means is included in the contact area between said image bearing member and the recording material borne by said recording material bearing member in the movement direction of said recording material bearing member.

16. An image forming apparatus according to claim 1, further comprising abrasive means for abrading said first layer of said recording material bearing member.

17. An image forming apparatus according to claim 16, wherein said first layer has a thickness of 20 to 200 $\mu$m.

18. An image forming apparatus according to claim 17, wherein a volume resistivity of said first layer is lower than that of said second layer.

19. An image forming apparatus according to claim 1, wherein said first layer includes a lubricating filler and said second layer does not include a lubricating filler.

20. An image forming apparatus according to claim 19, further comprising cleaning means for cleaning said first layer by being brought into contact with said first layer of said recording material bearing member.

21. An image forming apparatus according to claim 20, wherein said cleaning means comprises a blade in contact with said first layer.

22. An image forming apparatus according to claim 19, further comprising a driving roller for transmitting a driving force to said recording material bearing member by being brought into contact with said second layer of said recording material bearing member.

23. An image forming apparatus according to claim 1, wherein said first layer and said second layer are made of a polyimide resin.

24. An image forming apparatus according to one of claims 1 to 23, wherein said first layer has a surface resistivity of at least $10^{11}$ to $10^{14}$ $\Omega/\square$.

25. An image forming apparatus according to claim 24, wherein said second layer has a surface resistivity of at least $10^{15}$ $\Omega/\square$.

26. An image forming apparatus according to claim 25, wherein said image bearing member comprises a conductive layer electrically grounded and a photoconductive layer arranged on said conductive layer for bearing an image.

27. An image forming apparatus according to claim 1, further comprising fixing means for fixing the image to the recording material, wherein the image is fixed to a first surface of the recording material by using said fixing means and then said transfer means can transfer an image on said image bearing member to a second surface opposite to said first surface of the recording material borne by said recording material bearing member.

28. An image forming apparatus according to claim 27, wherein said fixing means fixes the image to the recording material by heating.

29. An image forming apparatus according to claim 1, wherein said transfer means sequentially transfers images having a plurality of colors from said image bearing member to the recording material borne by said recording material bearing member.

30. An image forming apparatus according to claim 1, comprising a plurality of image bearing members and a plurality of transfer means for sequentially transferring images having a plurality of colors from said plurality of image bearing members to the recording material borne by said recording material bearing member.

31. An image forming apparatus, comprising:

an image bearing member for bearing an image;

an intermediate transfer member to which the image on said image bearing member is transferred; and transfer means for transferring the image on said image bearing member electrostatically to said intermediate transfer member by being brought into contact with said intermediate transfer member, wherein a length of a contact area between said intermediate transfer member and said transfer means is less than that of a contact area between said image bearing member and said intermediate transfer member in a movement direction of said intermediate transfer member, wherein said intermediate transfer member comprises a first layer for bearing the image and a second layer with which said transfer means is brought into contact in transferring the image wherein a surface resistivity of said first layer is lower than a surface resistivity of said second layer.

32. An image forming apparatus according to claim 31, further comprising abrasive means for abrading said first layer.

33. An image forming apparatus according to claim 32, wherein a volume resistivity of said first layer is less than a volume resistivity of said second layer.

34. An image forming apparatus according to claim 31, wherein the length of the contact area between said intermediate transfer member and said transfer means is 0.3 to 1.5 mm in the movement direction of said intermediate transfer member.

35. An image forming apparatus according to claim 34, wherein said transfer means comprises a plate-shaped transfer member brought into contact with said intermediate transfer member transferring the image.

36. An image forming apparatus according to claim 35, wherein only a portion in the vicinity of an edge portion of said plate-shaped transfer member is brought into contact with said intermediate transfer member.

37. An image forming apparatus according to claim 31, wherein a length of an effective transfer area of said transfer means is equal to or less than the length of the contact area between said image bearing member and said intermediate transfer member in the movement direction of said intermediate transfer member.

38. An image forming apparatus according to claim 37, wherein the effective transfer area of said transfer means is included in the contact area between said image bearing member and the intermediate transfer member.

39. An image forming apparatus according to claim 31, wherein the contact area between said intermediate transfer member and said transfer means is included in the contact area between said image bearing member and said intermediate transfer member in the movement direction of said intermediate transfer member.

40. An image forming apparatus according to claim 31, wherein said first layer has a thickness of 20 to 200 $\mu$m.

41. An image forming apparatus according to claim 31, wherein said second layer has a thickness of 20 to 200 $\mu$m.

42. An image forming apparatus according to claim 31, further comprising cleaning means for cleaning said first layer by being brought into contact with said first layer of said intermediate transfer member, wherein said first layer includes a lubricating filler and said second layer does not include a lubricating filler.

43. An image forming apparatus according to claim 32, wherein said abrasive means abrades said first layer whenever images are formed on a predetermined number of recording materials.

44. An image forming apparatus according to claim 31, wherein said first and second layers are made of a polyimide resin.

45. An image forming apparatus according to claim 31, wherein said first layer has a surface resistivity of $10^{11}$ to $10^{14}$ $\Omega/\square$.

46. An image forming apparatus according to claim 32, wherein said second layer has a surface resistivity of at least $10^{15}$ $\Omega/\square$.

47. An image forming apparatus according to claim 31, wherein said intermediate transfer member comprises only said first and second layers.

48. An image forming apparatus according to claim 31, wherein images having a plurality of colors are sequentially transferred to said intermediate transfer member.

49. An image forming apparatus according to claim 48, comprising a plurality of image bearing members and a plurality of transfer means for sequentially transferring the images having the plurality of colors from said plurality of image bearing members to said intermediate transfer member.

* * * * *

UNITED STATES PATENT AND TRADEMARK OFFICE

CERTIFICATE OF CORRECTION

PATENT NO. : 6,385,426 B1
DATED : May 7, 2002
INVENTOR(S) : Yoichi Kimura et al.

It is certified that error appears in the above-identified patent and that said Letters Patent is hereby corrected as shown below:

Column 1,
Line 43, “an” (1st occurrence) should read -- a --.

Column 4,
Line 4, “exists” should read -- exist --.
Line 15, “V(v)” should read -- V(V) --.
Line 21, “pan” should read -- can --.
Line 35, “$I/L_X$” should read -- I/LX --.

Column 6,
Line 4, “Image” should read -- image --.
Line 52, “substrate 1A” should read -- substrate 1A. --.

Column 8,
Line 44, “the ears” should read -- ears --.

Column 10,
Line 25, “3-methoxyhexamethylenediamlne” should read
-- 3-methoxyhexamethylenediamine --.

Column 11,
Line 28, “strengthened” should read -- strengthened by --.

Column 12,
Line 29, “thicker” should read -- the thicker --.
Line 30, “higher” should read -- the higher --.

Column 16,
Line 66, “small-size” should read -- small-sized --.
Line 67, “It” should read -- R --.

Column 17,
Line 12, “this-embodiment” should read -- this embodiment --.
Line 38, “cause” should read -- causes --.

Column 20,
Line 19, “an” should read -- a --.

UNITED STATES PATENT AND TRADEMARK OFFICE

CERTIFICATE OF CORRECTION

PATENT NO. : 6,385,426 B1
DATED : May 7, 2002
INVENTOR(S) : Yoichi Kimura et al.

It is certified that error appears in the above-identified patent and that said Letters Patent is hereby corrected as shown below:

Column 21,
Line 3, “beating” should read -- bearing --.
Line 53, “aid” should read -- said --.

Column 23,
Line 12, “image” should read -- image, and --.

Column 24,
Line 37, “comprising” should read -- further comprising --.

Signed and Sealed this

Thirtieth Day of July, 2002

*Attest:*

*Attesting Officer*

JAMES E. ROGAN
*Director of the United States Patent and Trademark Office*